US009393669B2

(12) United States Patent
Kalenian et al.

(10) Patent No.: US 9,393,669 B2
(45) Date of Patent: Jul. 19, 2016

(54) SYSTEMS AND METHODS OF PROCESSING SUBSTRATES

(71) Applicant: Strasbaugh, San Luis Obispo, CA (US)

(72) Inventors: William J. Kalenian, San Luis Obispo, CA (US); Thomas A. Walsh, Atascadero, CA (US); Michael R. Vogtmann, San Luis Obispo, CA (US); Benjamin C. Smedley, San Luis Obispo, CA (US); Larry A. Spiegel, Atascadero, CA (US); Thomas E. Brake, San Luis Obispo, CA (US)

(73) Assignee: Strasbaugh, San Luis Obispo, CA (US)

( * ) Notice: Subject to any disclaimer, the term of this patent is extended or adjusted under 35 U.S.C. 154(b) by 736 days.

(21) Appl. No.: 13/740,101

(22) Filed: Jan. 11, 2013

(65) Prior Publication Data

US 2013/0130593 A1 May 23, 2013

Related U.S. Application Data

(63) Continuation-in-part of application No. 13/656,514, filed on Oct. 19, 2012, now Pat. No. 8,968,052.

(60) Provisional application No. 61/585,643, filed on Jan. 11, 2012, provisional application No. 61/549,787, (Continued)

(51) Int. Cl.

| | |
|---|---|
| ***B24B 49/00*** | (2012.01) |
| ***B24B 49/04*** | (2006.01) |
| ***B24B 7/22*** | (2006.01) |

(52) U.S. Cl.

CPC ..... *B24B 49/00* (2013.01); *B24B 7/228* (2013.01); *B24B 49/04* (2013.01)

(58) Field of Classification Search

CPC ..... B24B 49/00; B24B 7/228; B24B 49/04; B24B 37/013; B24B 37/206; B24B 37/04

USPC ..... 451/6, 11

See application file for complete search history.

(56) References Cited

U.S. PATENT DOCUMENTS

| | | | |
|---|---|---|---|
| 2,665,589 | A | 1/1954 | Rusher |
| 2,968,133 | A | 1/1961 | Reichardt |

(Continued)

FOREIGN PATENT DOCUMENTS

| | | |
|---|---|---|
| JP | 2006120757 | 5/2006 |
| WO | 2013059705 | 4/2013 |
| WO | 2013106777 | 7/2013 |

OTHER PUBLICATIONS

Sony; "Digital Gauge Measuring Unit DK SERIES"; Catalog #497; 2005; 2 Pages.

(Continued)

*Primary Examiner* — George Nguyen

(74) *Attorney, Agent, or Firm* — Fitch, Even, Tabin & Flannery LLP

(57) ABSTRACT

Some embodiments provide methods of processing wafers comprising: positioning a stacked wafer into a position to be ground, wherein the stacked wafer comprises a first wafer secured with a carrier-wafer, wherein the first wafer is secured with the carrier-wafer such that a surface of the first wafer is exposed to be ground; initiating a grinding of the first wafer while supported by the carrier-wafer; activating one or more sensors relative to the first wafer while grinding the first wafer; determining, while grinding the first wafer, a thickness of the first wafer separate from a thickness of the carrier-wafer as a function of data from the one or more sensors; determining whether the determined thickness of the first wafer has a predefined relationship with a first thickness threshold; and halting the wafer grinding when the thickness of the first wafer has the predefined relationship with the first thickness threshold.

18 Claims, 10 Drawing Sheets

Related U.S. Application Data filed on Oct. 21, 2011, provisional application No. 61/708,146, filed on Oct. 1, 2012, provisional application No. 61/708,165, filed on Oct. 1, 2012, provisional application No. 61/632,262, filed on Jan. 23, 2012, provisional application No. 61/631,102, filed on Dec. 28, 2011.

(56) References Cited

U.S. PATENT DOCUMENTS

| | | | | |
|---|---|---|---|---|
| 3,142,942 | A | 8/1964 | Celovsky | |
| 3,715,841 | A | 2/1973 | Schnellman | |
| 3,885,925 | A | 5/1975 | Tatar | |
| 4,109,552 | A | 8/1978 | Imoberdorf | |
| 4,897,362 | A * | 1/1990 | Delgado | H01L 21/187 148/33.4 |
| 5,067,085 | A * | 11/1991 | Wenzel | B25J 9/1684 451/5 |
| 5,240,883 | A * | 8/1993 | Abe | H01L 21/2007 148/DIG. 127 |
| 5,718,619 | A | 2/1998 | Merrill | |
| 5,964,646 | A | 10/1999 | Kassir et al. | |
| 6,090,688 | A * | 7/2000 | Ogawa | H01L 21/302 216/20 |
| 6,190,234 | B1 * | 2/2001 | Swedek | B24B 37/013 257/E21.23 |
| 6,254,155 | B1 | 7/2001 | Kassir | |
| 6,336,849 | B1 | 1/2002 | Konnemann | |
| 6,343,980 | B1 | 2/2002 | Abe | |
| 6,386,956 | B1 | 5/2002 | Sato | |
| 6,402,589 | B1 | 6/2002 | Inaba et al. | |
| 6,534,384 | B2 * | 3/2003 | Nakano | H01L 21/2007 257/E21.122 |
| 6,624,047 | B1 * | 9/2003 | Sakaguchi | H01L 21/76251 257/347 |
| 6,638,389 | B2 | 10/2003 | Kassir et al. | |
| 6,866,564 | B2 | 3/2005 | Strasbaugh et al. | |
| 6,976,901 | B1 | 12/2005 | Halley et al. | |
| 7,004,818 | B1 | 2/2006 | Haney | |
| 7,014,540 | B2 | 3/2006 | Nagel | |
| 7,018,268 | B2 | 3/2006 | Kassir et al. | |
| 7,022,000 | B2 | 4/2006 | Mizomoto et al. | |
| 7,059,942 | B2 | 6/2006 | Strasbaugh et al. | |
| 7,118,446 | B2 | 10/2006 | Walsh et al. | |
| 7,160,808 | B2 | 1/2007 | Kassir | |
| 7,402,093 | B2 | 7/2008 | Sjolander | |
| 7,458,878 | B2 | 12/2008 | Walsh et al. | |
| 8,133,093 | B2 | 3/2012 | Vogtmann et al. | |
| 8,520,222 | B2 | 8/2013 | Schraub et al. | |
| 8,968,052 | B2 * | 3/2015 | Walsh | B24B 37/013 451/10 |
| 2001/0002359 | A1 | 5/2001 | Matsuo | |
| 2002/0006768 | A1 | 1/2002 | Wada et al. | |
| 2002/0042243 | A1 * | 4/2002 | Ihsikawa | B24B 37/013 451/6 |
| 2002/0102144 | A1 | 8/2002 | Linderholm | |
| 2002/0127950 | A1 * | 9/2002 | Hirose | B24B 37/013 451/6 |
| 2003/0124961 | A1 | 7/2003 | Haney | |
| 2003/0232581 | A1 | 12/2003 | Ki | |
| 2004/0011462 | A1 | 1/2004 | Gotkis et al. | |
| 2004/0053500 | A1 * | 3/2004 | Shemer | B24B 37/013 438/692 |
| 2004/0063385 | A1 | 4/2004 | Perlov | |
| 2004/0124509 | A1 * | 7/2004 | Kim | H01L 21/76898 257/678 |
| 2005/0026543 | A1 * | 2/2005 | Han | B24B 49/04 451/5 |
| 2005/0176350 | A1 | 8/2005 | Gerber | |
| 2005/0227587 | A1 * | 10/2005 | Yang | B24B 49/12 451/6 |
| 2006/0194513 | A1 | 8/2006 | Saxler | |
| 2007/0128983 | A1 | 6/2007 | Walsh et al. | |
| 2008/0090505 | A1 | 4/2008 | Yoshida | |
| 2009/0203299 | A1 | 8/2009 | Kashiwa | |
| 2010/0285665 | A1 | 11/2010 | Takai et al. | |
| 2011/0014774 | A1 * | 1/2011 | Johnson | H01L 21/67092 438/455 |
| 2012/0239182 | A1 | 9/2012 | Kikata | |
| 2013/0102227 | A1 | 4/2013 | Walsh et al. | |
| 2013/0130593 | A1 * | 5/2013 | Kalenian | B24B 49/00 451/5 |

OTHER PUBLICATIONS

Heidenhain Encoders; "Heidenhain Magnetic Modular Encoders" Internet Catalog; At least Jul. 2011; 1 Page.

THK; "Features of the Cross-Roller Ring—THK Technical Support"; Published before Oct. 2011; 3 Pages.

Tamar Technology; WTS Optical Head; Published before Oct. 21, 2011; 4 Pages.

Tamar Technology; Reference Manual for Wafer Thickness Sensor <WTS) WinSock Server; Version 1.0; Feb. 15, 2011; 23 Pages.

PCT; Notification of Transmittal of the International Search Report and the Written Opinion of the International Searching Authority issued in International Patent Application No. PCT/US2012/061169; Mailed Mar. 8, 2013; 2 pages; FETF.

PCT; International Search Report issued in International Patent Application No. PCT/US2012/061169; Mailed Mar. 8, 2013; 3 pages; FETF.

PCT; Written Opinion of the International Searching Authority issued in International Patent Application No. PCT/US2012/061169; Mailed Mar. 8, 2013; 4 pages; FETF.

PCT; Notification of Transmittal of the International Search Report and the Written Opinion of the International Searching Authority issued in International Patent Application No. PCT/US2013/021319; Mailed Mar. 19, 2013; 2 pages; FETF.

PCT; International Search Report issued in International Patent Application No. PCT/US2013/021319; Mailed Mar. 19, 2013; 2 pages; FETF.

PCT; Written Opinion of the International Searching Authority issued in International Patent Application No. PCT/US2013/021319; Mailed Mar. 19, 2013; 4 pages; FETF.

Walsh et al.; U.S. Appl. No. 14/042,600, filed Sep. 30, 2013; 39 Pages; FETF.

Brake et al.; U.S. Appl. No. 14/042,591, filed Sep. 30, 2013; 39 Pages; FETF.

USPTO; Non-Final Office Action from U.S. Appl. No. 14/042,600 mailed Mar. 3, 2015 (9417-131448).

USPTO; Notice of Allowance from U.S. Appl. No. 13/656,514 mailed Oct. 30, 2014 (9417-104156-US).

USPTO: Restriction Requirement issued in U.S. Appl. No. 14/042,591 mailed Feb. 9, 2015 (9417-131447-US).

USPTO; Non-final office action from U.S. Appl. No. 13/656,514; Jul. 24, 2014; 25 pgs (9417-104156-US).

USPTO; Non-Final Office Action from U.S. Appl. No. 14/042,591 mailed Jun. 15, 2015 (9417-131447-US).

USPTO; Final Office Action from U.S. Appl. No. 14/042,591 mailed Dec. 18, 2015 (9417-131447-US).

USPTO; Non-final office action issued in U.S. Appl. No. 14/042,600 mailed Oct. 2, 2015 (9417-131448-US).

Puligadda et al.; "High-Performance Temporary Adhesives for Wafer Bonding Applications"; Enabling Technologies for 3-D Integration; Mater. Res. Soc. Symp. Proc. vol. 970; 2007; 18 pages.

USPTO; Non-final office action from U.S. Appl. No. 14/042,600 mailed May 3, 2016.

USPTO; Notice of Allowance from U.S. Appl. No. 14/042,591 mailed Jun. 3, 2016.

* cited by examiner

Notes:

> Skins and doors are removed or partially transparent for clarity

> Electrical & controls are, in some embodiments, packaged in the cabinet (e.g., at the rear and/or side of the grind module)

> Facilities, in some embodiments, enter beneath the grind engine at the rear or side of the grind module > Fluid handling is, in some embodiments, beneath the grind engine

SYSTEMS AND METHODS OF PROCESSING SUBSTRATES

This application claims the benefit of U.S. Provisional Application No. 61/585,643, filed Jan. 11, 2012, for Walsh et al., entitled SYSTEMS AND METHODS OF PROCESSING SUBSTRATES; and this application is a continuation-in-part of U.S. application Ser. No. 13/656,514, filed Oct. 19, 2012, for Walsh et al., entitled SYSTEMS AND METHODS OF WAFER GRINDING, which claims the benefit of U.S. Provisional Application No. 61/549,787, filed Oct. 21, 2011, for Walsh et al., entitled SYSTEMS AND METHODS OF WAFER GRINDING, U.S. Provisional Application No. 61/585,643, filed Jan. 11, 2012, for Walsh et al., entitled SYSTEMS AND METHODS OF PROCESSING SUBSTRATES, U.S. Provisional Application No. 61/708,146, filed Oct. 1, 2012, for Brake et al., entitled METHODS AND SYSTEMS FOR USE IN GRIND SHAPE CONTROL ADAPTATION, U.S. Provisional Application No. 61/708,165, filed Oct. 1, 2012, for Walsh et al., entitled METHODS AND SYSTEMS FOR USE IN GRIND SPINDLE ALIGNMENT, U.S. Provisional Application No. 61/632,262, filed Jan. 23, 2012, for Vogtmann et al., entitled METHOD AND APPARATUS FOR CLEANING GRINDING WORK CHUCK USING A SCRAPER, and U.S. Provisional Application No. 61/631,102, filed Dec. 28, 2011, for Michael Vogtmann, entitled METHOD AND APPARATUS FOR CLEANING GRINDING WORKCHUCK USING A VACUUM; each of which is incorporated in its entirety herein by reference.

BACKGROUND

1. Field of the Invention

The present invention relates generally to wafer processing, and more specifically to wafer grinding.

2. Discussion of the Related Art

It is common, such as with some conventional semiconductor wafers on which circuit patterns are formed on one side (a front side), to be subjected to a grinding process so as to reduce the overall thickness of the wafer. Grinding is typically performed on the back surface of the wafer. The resultant thinning of the wafer allows for the production of thinner packaged electronic chips, microchips, and the like. In some instances, the thickness of a microchip cannot exceed a predefined thickness. Various other advantages are achieved by reducing the thickness of the wafers.

Backside wafer grinding is often accomplished using a grinding wheel that is applied to the backside of the wafer. Pressure is applied while grinding in attempts to achieve desired thicknesses.

SUMMARY OF THE INVENTION

Several embodiments of the invention advantageously address the needs above as well as other needs by providing methods of processing wafers comprising: positioning a stacked wafer into a position to be ground, wherein the stacked wafer comprises a first wafer secured with a carrier-wafer, wherein the first wafer is secured with the carrier-wafer such that a surface of the first wafer is exposed to be ground; initiating a grinding of the first wafer while supported by the carrier-wafer; activating one or more sensors relative to the first wafer while grinding the first wafer; determining, while grinding the first wafer, a thickness of the first wafer separate from a thickness of the carrier-wafer as a function of data from the one or more sensors; determining whether the determined thickness of the first wafer has a predefined relationship with a first thickness threshold; and halting the wafer grinding when the thickness of the first wafer has the predefined relationship with the first thickness threshold.

Other embodiments provide methods of grinding a wafer comprising: positioning a stacked wafer onto a work chuck, wherein the work chuck is secured with a rotary indexer and the stacked wafer comprises a first wafer to be ground; moving the rotary indexer to move the work chuck to position the stacked wafer proximate a first probe; rotating the work chuck to rotate the stacked wafer while coordinating movement of the rotary indexer moving the work chuck and stacked wafer relative to the first probe while the first probe is activated; obtaining a mapping of a surface shape of a surface of a carrier-wafer; and modifying a grinding of the first wafer to be ground in accordance with the mapping of the surface of the carrier-wafer, wherein the carrier-wafer is configured to support the first wafer while the first wafer is being ground.

BRIEF DESCRIPTION OF THE DRAWINGS

The above and other aspects, features and advantages of several embodiments of the present invention will be more apparent from the following more particular description thereof, presented in conjunction with the following drawings.

Figure 1:
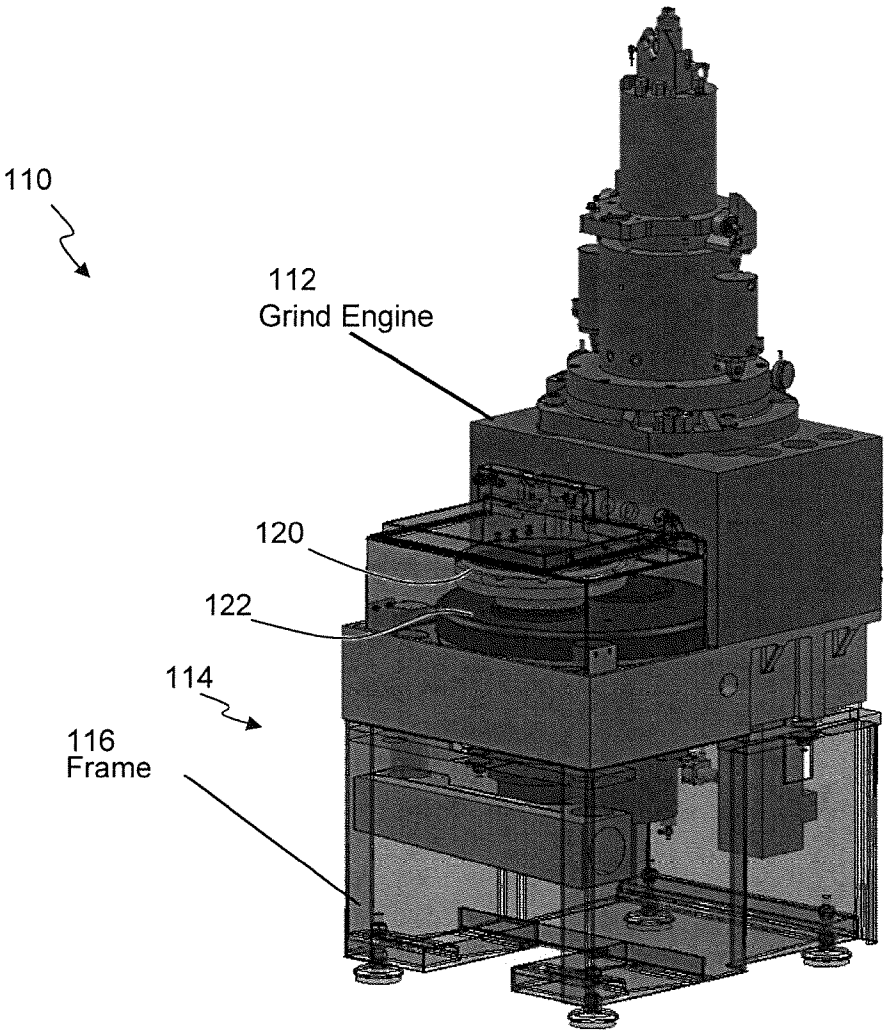
FIG. 1 depicts a simplified, partially transparent, perspective view of a grind system or module, in accordance with some embodiments.

Corresponding reference characters indicate corresponding components throughout the several views of the drawings. Skilled artisans will appreciate that elements in the figures are illustrated for simplicity and clarity and have not necessarily been drawn to scale. For example, the dimensions of some of the elements in the figures may be exaggerated relative to other elements to help to improve understanding of various embodiments of the present invention. Also, common but well-understood elements that are useful or necessary in a commercially feasible embodiment are often not depicted in order to facilitate a less obstructed view of these various embodiments of the present invention.

DETAILED DESCRIPTION

The following description is not to be taken in a limiting sense, but is made merely for the purpose of describing the general principles of exemplary embodiments.

Reference throughout this specification to "one embodiment," "an embodiment," "some embodiments," "some implementations" or similar language means that a particular feature, structure, or characteristic described in connection with the embodiment is included in at least one embodiment of the present invention. Thus, appearances of the phrases "in one embodiment," "in an embodiment," "in some embodiments," and similar language throughout this specification may, but do not necessarily, all refer to the same embodiment.

Furthermore, the described features, structures, or characteristics of the invention may be combined in any suitable manner in one or more embodiments. In the following description, numerous specific details are provided, such as examples of configurations, cooperation between components, processing, coordination, programming, software modules, user interfaces, user operations and/or selections, communications and/or network transactions, memory and/or database queries, database structures, hardware modules, hardware circuits, hardware chips, etc., to provide a thorough understanding of embodiments of the invention. One skilled in the relevant art will recognize, however, that the invention can be practiced without one or more of the specific details, or with other structures, features, methods, components, materials, and so forth. In other instances, well-known structures, materials, or operations are not shown or described in detail to avoid obscuring aspects of the invention.

Some present embodiments provide for grinding of work products, including but not limited to wafer backgrinding (e.g., semiconductor wafer backgrinding). For example, some embodiments provide for silicon wafer grinding for semiconductors and/or other relatively hard materials wafer grinding, including for example grinding for Light-Emitting Diode (LED) manufacture. In some instances, the grinding systems and/or processes can include, be implemented and/or cooperated with other systems and/or apparatuses, such as robotics, front-end modules, automation machines, thin wafer handling, in situ and ex situ wafer thickness monitoring, grind force measurement, servicing access for grinder components (like grind wheels), and other such systems and/or automations.

Some embodiments provide systems and methods of wafer grinding that comprise several sub-systems and improvements over the prior systems and methods. Many of these sub-systems provide inventive features and processes, and the methods and/or processes of using each, the cooperation between two or more and the entire system provides methods to achieve levels of ground wafer quality not achievable by means of other equipment or methods.

Further, some embodiments provide integrated grind engines, which may be partially manually or fully-automated platforms. Additionally, embodiments provide methods of grinding substrates in accordance with the integrated grind engines. The grind engines can be used to grind various types of substrates, such as silicon, stacked silicon wafers that can be processed for example with through silicon via (TSV), back side illumination (BSI) and/or other applications, and "hard" materials such as, but not limited to, sapphire, silicon carbide, Aluminum-Titanium Carbide (AlTiC), silicon nitride used for LED applications, giant magnetoresistive (GMR) hard disk drive (HDD) heads and other such relatively hard materials. The configuration of the grind engine or tool and process methods used to grind can be different for each material type.

FIG. 1 depicts a simplified, partially transparent, perspective view of a grind system or module 110 according to some embodiments. The grind module 110 includes a grind engine 112. In some embodiments, the grind module further includes the grind engine integrated into a platform 114 that includes a frame 116, one or more electrical systems, and one or more controls system. Some embodiments further include fluid handling equipment, walls, venting air system, covers or skins, doors, windows, facilities and/or communication connections, stress-relieving devices (e.g., a polishing device), and other components.

The grind engine 112, in some embodiments, includes a grind spindle, work chuck or chucks 120, spindles, chucks to secure objects and rotary indexer 122 coupled to an indexing mechanism. Some embodiments further include one or more measurement probes, such as one or more probes to monitor thickness of a substrate being ground. Additionally, some embodiments are equipped with other metrology to monitor vibrations, temperatures, forces and/or other relevant parameters that can be used in implementing and/or controlling grinding. The grind spindle, can in some embodiments, be implemented through a dual shaft air bearing grind spindle. For example, the grind spindle can be implemented using the spindle described in U.S. Pat. No. 7,118,446, which is incorporated herein by reference. The grind spindle can be cooperated with a grind wheel or nested coarse and fine grind wheels used in grinding.

Figure 2:
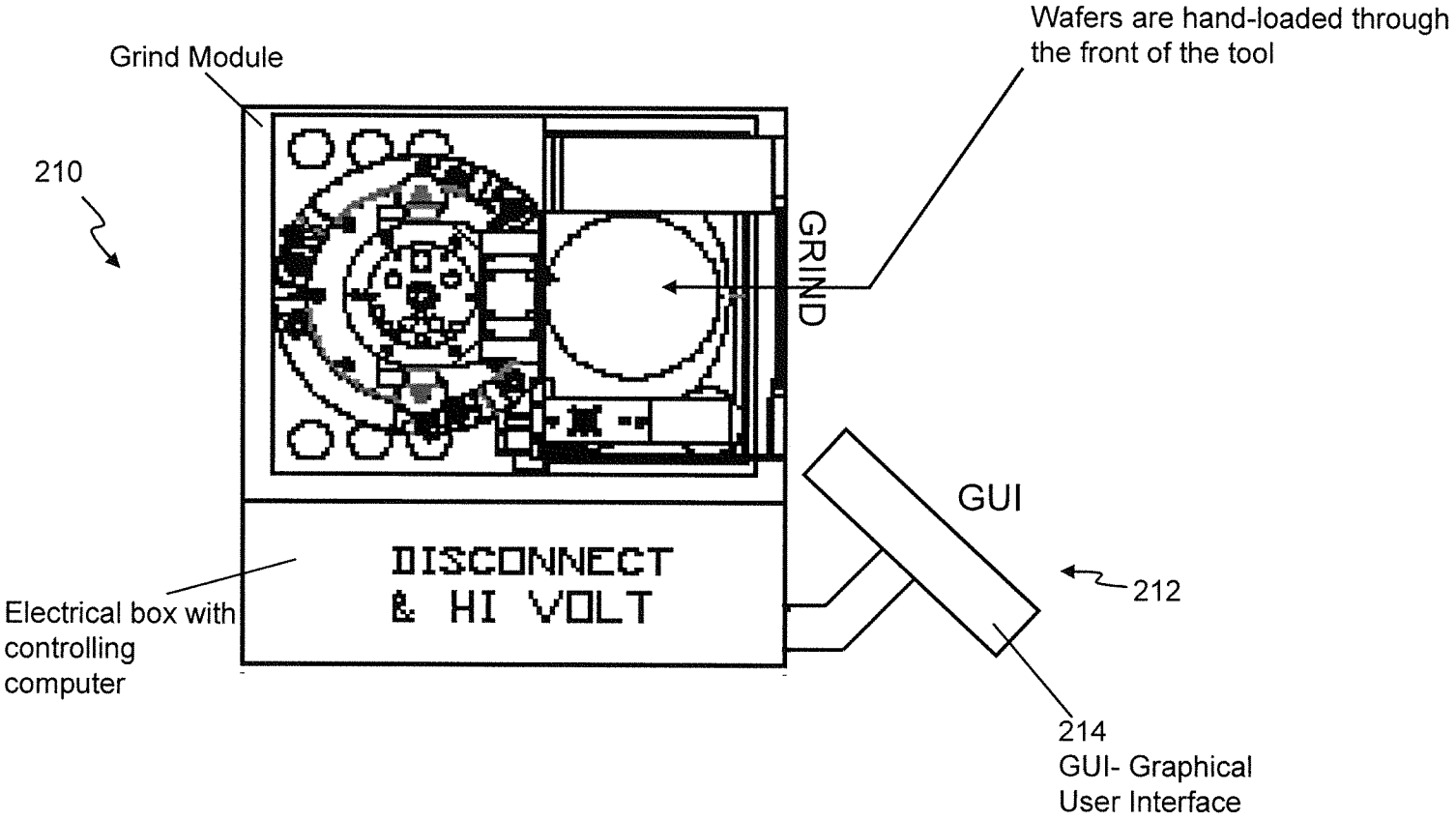
FIG. 2 depicts a simplified block diagram, overhead plane view of a grind module, in accordance with some embodiments.

FIG. 2 depicts a simplified block diagram, overhead plane view of a grind module 210 according to some embodiments. The grind module 210 is shown in a stand alone configuration without being cooperated with other components and/or systems. As such, the grind module 210 may be utilized generally in a manual mode, where an operator can hand-feed substrates (e.g., wafers) into and remove the substrates out of the module 210. In some instances, the user further operates the grind module 210 through a computer user interface 212, which can include and/or display a graphical user interface 214 and corresponding computer, processor, memory and the like to allow the user to interact with the grind module 210 and control the grind process (e.g., by specifying a grind recipe, defining grind parameters, speed of rotations, forces, time of grind, and the like). The grinding module 210 and/or engine can be implemented, in some instances, through the grinding module or system described in co-pending application Ser. No. 61/549,787, filed Oct. 21, 2011, entitled SYSTEMS AND METHODS OF WAFER GRINDING, which is incorporated herein by reference.

Figure 3:
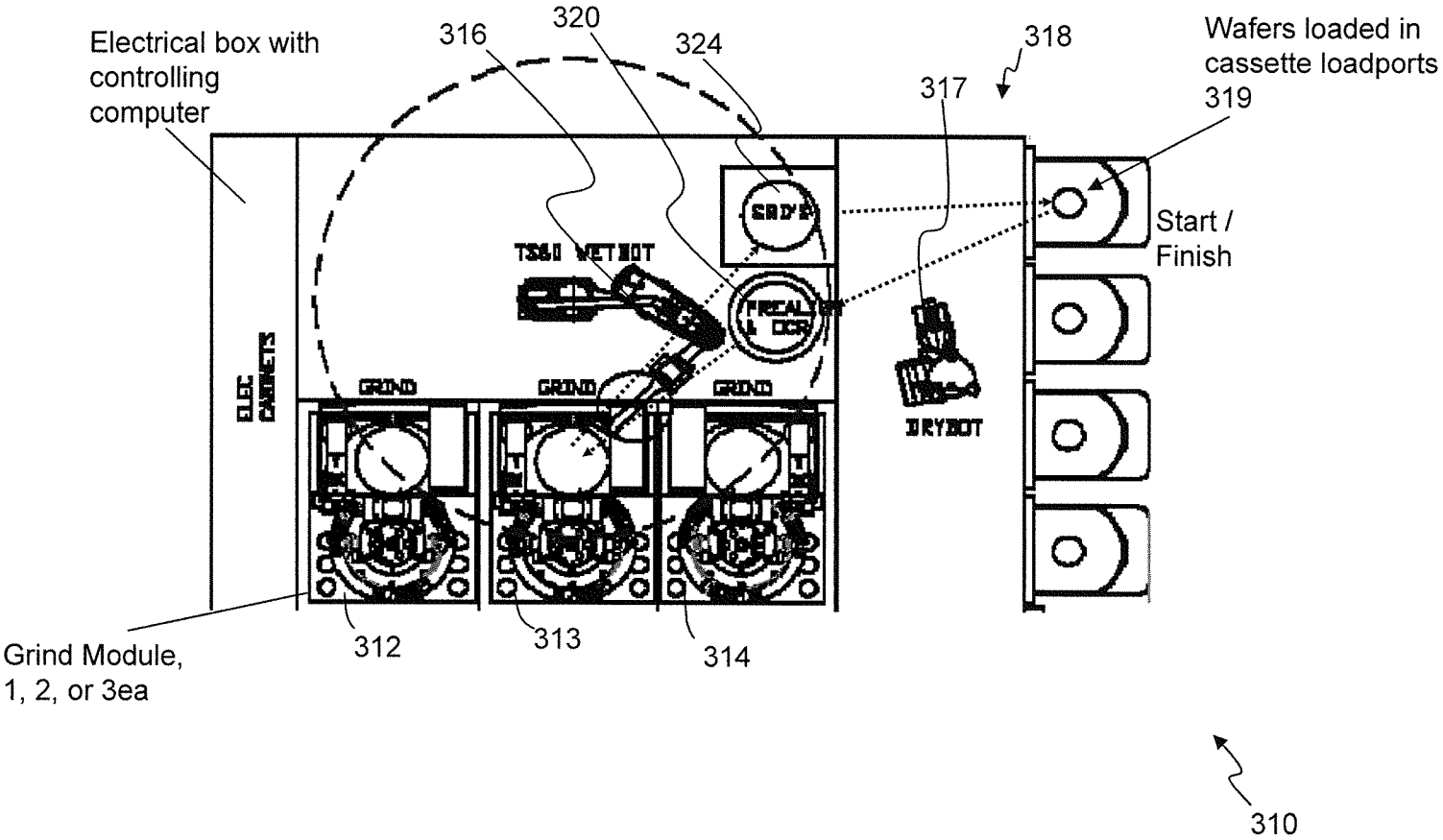
FIG. 3 shows an overhead view of a grind system, in accordance with some embodiments.

FIG. 3 shows an overhead view of a grind system 310, according to some embodiments. The grind system 310 can include one or more grind modules 312-314 (e.g., similar to the grind module 210 of FIG. 2) that can be combined with other hardware, such as, but not limited to, robot handling equipment, cassette loaders, metrology, sensors, and other components or items. In some instances, the other hardware in cooperation with one or more controllers implementing control applications can provide some automation, and in many embodiments provide substantially fully-automated platforms.

The platform has one or more grind modules 312-314 and can include substantially any relevant number of grind modules, which can be cooperated and/or ganged together into an arrangement. Multiple grind modules can increase FEM utilization and conserves cleanroom floor space. In some embodiments, the compact design of the grind modules (such as the grind module 210 of FIG. 2) allows multiple grind modules to be conveniently packaged into a desired configuration, such as a linear row, in a "cluster" arrangement (e.g., "L" shape, partially circular, circular, or other arrangement) or substantially any relevant configuration. Modular grinders can be operated in serial or parallel flows, which is typically not achievable using other existing grinder architectures having a single turret servicing multiple grind spindles. This can allow for more process flexibility, greater throughputs, more easily configurable for various processes (e.g., 1, 2, 3 or more modules), easier alignments (alignments of each module can be independent), and other such benefits.

Some embodiments include a wet wafer handling robot ("Wetbot") 316. The grind modules 312-314 are fed substrates (e.g., wafers, stacked wafers, Hard Substrates, etc.) via one or more wet robots 316 that can reach into chambers of the grind modules. The one or more wet robots 316 are configured to operate in damp environments and handle wet substrates.

An equipment front end module (EFEM) 318 may, in some embodiments, be integrated with the one or more grind modules and wet robots 316. EFEM's are commonly used in the Semiconductor industry as a way to temporarily store and introduce material into a process tool. EFEM's are available from different vendors such as Genmark, Crossing Automation, and Rorze. The EFEM, in some embodiments, can include one or more cassette loadports 319, a dry robot 317 (to handle exclusively dry, clean substrates), a pre-aligner 320, one or more sensors (e.g., an optical character recognition device ("OCR")), and/or other such components. Some embodiments include a pre-aligner 320 cooperated with the grind modules 312-314 and/or incorporated into a grind module or engine. The cassette loadport(s) provides a cassette I/O device that temporarily stores wafers before and after processing. The cassettes may be open, Front Opening Unified Pod (FOUP), SMIF type, or other such cassettes commonly used by the Semiconductor industry. For example, with 300 mm Semiconductor applications, such as in a factory or facility with automated movement of FOUP's, one or more FOUP loadports can be used.

The one or more dry robot ("Drybot") 317 can be used to remove and replace wafers into relevant cassettes 319 before and after processing. In some configurations separate wet and dry robots 316-317 are not required and a single robot may be sufficient for both wet and dry wafer handling, such as with relatively low throughput. In those instances when discrete wet and dry handling is needed with in the single robot configuration, some embodiments comprise separate wet and dry end effectors can be used by the same robot, such as a system similar to that described in U.S. Pat. No. 7,249,992, which is incorporated herein by reference, which allows a first end effector (e.g., dry end effector) to be disengaged from the robot such that the robot can engage and manipulate a second end effector (e.g., wet end effector), and similarly, the second end effector can be disengaged from the robot and the first end effector be reengaged with and manipulated by the robot.

The pre-aligner 320 can be used in some implementations to temporarily hold and locate the center of wafers so that the wafers may be accurately placed (e.g., placed precisely centered) on the grind chuck of one of the grind modules 312-314. The pre-aligner may physically center the wafer on a stage for pick-up by the wet robot 316, or it may simply provide the wafer center location to a controller (e.g., a computer) that controls the wet robot. The wet robot uses the information to pick-up and place the wafer in a correct location. In some instances, the pre-aligner and/or sensors associated with the pre-aligner may also be used to locate a reference on the wafer (e.g., locate a flat or notch on a wafer).

An optical character recognition device (OCR) can be employed to read indentifying numbers, letters, bar code or other such identifying markings that are printed, formed or otherwise incorporated with a substrate to be ground. In some embodiments, the OCR is integrated into the pre-aligning device 320. The information is used to track and verify wafer flow through the grind system 310 and/or a factory. It also can provide a means for a factory host to send recipe and/or metrology information needed to process the wafer down to the grind system 310 and/or grinding platform.

In some embodiments, the grind system 310 further includes one or more spin rinse dryers (SRD) 324 or the like. After grinding, a wafer is typically wet with effluent used to cool the grinding process, and often from subsequent rinsing of the wafer. The one or more SRDs 324 can be used to spin the wafer rapidly to remove the liquid from the wafer and dry the wafer. In some instances a fluid may be applied to further wash the wafer. In some embodiments, one or more streams or flows of gas may be applied to the wafer while drying the wafer. Typically, the wet robot 316 places the wet wafer into the SRD 324 for drying. After drying, the wafer can be put back into the cassette by the dry robot 317. Therefore, both the wet and dry robots can be positioned, in such implementations, to have access to the SRD 324 (or to at least one of the SRDs when multiple SRDs are employed). One or more SRDs 324 may be integrated into the grind system 312, typically depending on desired throughput. For example, in some grinding processes the handling system may be able to keep up with processing, but a single SRD may not be sufficient. In such instances, an additional optional SRD may be added so as not to inhibit machine throughput. Some embodiments can additionally or alternatively include polishing modules, etching modules and/or other relevant modules that can be cooperated with the grind system 310 and/or used in place of one or more of the grind modules 312-314. Similarly, in some embodiments, the grind modules 312-314 are configured to further provide for wafer polishing, etching, stress-relieving, and/or other such operations.

Backgrinding Non-Stacked Substrates

Figure 4:
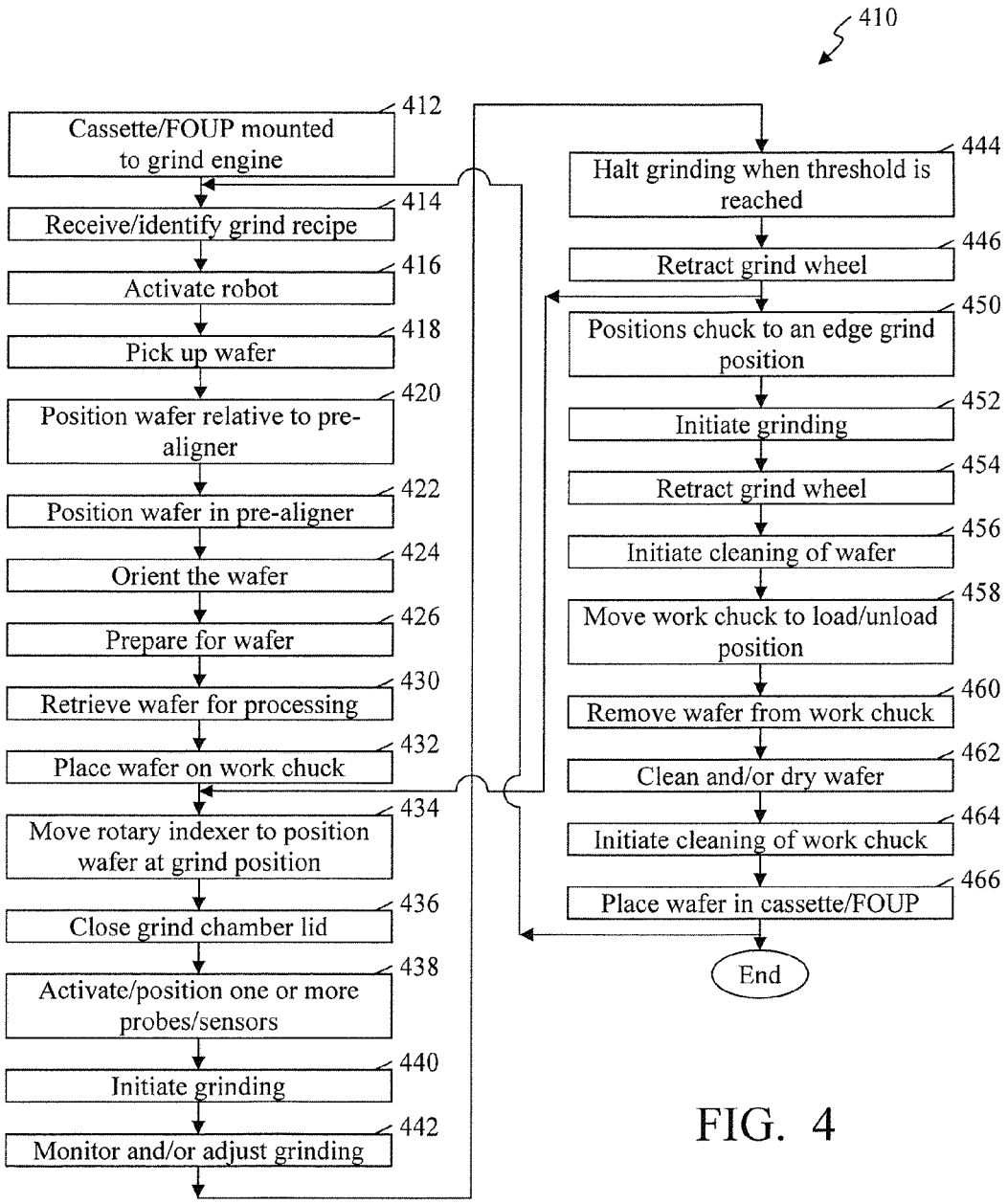
FIG. 4 shows a simplified flow diagram of an example process that can be used to perform back grinding of wafers, in accordance with some embodiments.

Below is described and FIG. 4 shows a simplified flow diagram of an example process 410 that can be used to perform back grinding of finished semiconductor device wafers, for grinding used in the manufacture of prime silicon wafers and other such grinding or processing, in accordance with some embodiments. For example, in some implementations the process can be used in grinding a substrate, such as a non-stacked semiconductor wafers. Further, in some instances, the process can be used with two or more work chuck configurations (e.g., dual work chuck configurations), which can increase throughput.

1. One or more cassettes or FOUPs of wafers are loaded into a cassette I/O device mounted (step 412) to the EFEM of a grind system (e.g., grind system 310), which may be partially or substantially fully automated. In some instances, one or more empty cassettes may also be loaded as output (or "receive") cassettes for some configurations.

2. An operator or factory host specifies a recipe to be used for grinding (step 414). In some instances, the recipe and/or flow are defined prior to the cassette being cooperated with the EFEM. Additionally or alternatively, the recipe and/or flow are identified in response to an identification of the wafer, wafer type, cassette or some other identification, which may be performed by the EFEM or other identifier of the grind system. Further, the machine logic and/or programming can determine the flow path of the one or more wafers. Recipes are provided and/or developed that can maximize throughput and/or improve results. In some instances, recipes can be given identifiers (e.g., names), which can be used call upon by an operator maiming the tool and/or the factory host.

3. The dry robot 317 or a controller detects the presence of the wafer and/or is instructed through the controller to retrieve a wafer (step 416). For example, in some embodiments, the dry robot 317 uses a scanning device to scan the input and output cassette(s) for wafer presence. Alternatively, the cassettes can be scanned by the cassette I/O device (for example, FOUP loadports may have integrated wafer scanning capability).

4. The dry robot 317 uses an end effector to pick up a wafer (step 418), for example, from a bottom-side from the input cassette and withdraw the wafer from the cassette and into the EFEM.

5. The wafer is moved to a position to be placed into the pre-aligner 320 (step 420). In some instances, the wafer is positioned in a predefined orientation, such as the dry robot rotating the wafer 180° resulting in the end effector on top of the wafer. Often, wafers stored in a cassette are stored with the device side up. The wafers can be aligned with the device side up and then flipped and placed on the chuck of the prealigner with the device side down (where typically, in previous systems, a wafer is flipped prior to the prealigner).

6. The wafer is placed by the dry robot onto a chuck or other such structure of the pre-aligner 320 (step 422).

7. The pre-aligner 320 centers (or finds the center of) and may orient the wafer to a predefined angle (e.g., recipe or user defined angle) relative to the end effector pick direction (step 424). A wafer ID, if present, may also be read by the OCR during the pre-aligning process.

8. In some embodiments, during the pre-align process, the grind module prepares for the wafer (step 426). For example, the top surface of the work chuck can be cleaned with a work chuck cleaning assembly of the grind system; a rotary indexer indexes the work chuck to the grind position and in some instances one or more probes or sensors (e.g., two contact probes) can reference the top of the work chuck; the rotary indexer indexes the work chuck to the load/unload position; the work chuck may be indexed to a desired orientation (e.g., recipe or user-defined orientation); and the grind chamber lid can be opened.

9. The wet robot 316 picks the wafer from the pre-aligner 320 using a wet wafer end effector (step 430).

10. The wet robot 316 places the wafer on top of the work chuck in the grind module (e.g., grind module 312) (step 432). A vacuum is activated to induce a vacuum force that is pulled through the porous surface of the work chuck to seat and hold the wafer against the work chuck. The wet robot end effector releases the wafer and retracts from the grind module.

11. The rotary indexer indexes the work chuck to the grind position (step 434). In some instances, the grinding may be implanted in multiple phases, such as a coarse grind and a fine grind. Additionally, an edge grind or other relevant grind may be implemented. Accordingly, the positioning may correspond to a coarse grind position.

12. The grind chamber lid is closed (step 436).

13. One or more probes or sensors are activated and/or positioned to sense the position and/or progress of the grinding (step 438). For example, one or more contact probes are positioned relative to the wafer and/or chuck, such as, one contacting on the wafer and another on the exposed area of the work chuck (e.g., a non-porous outer diameter portion of the work chuck). The probe contacting the wafer is used to measure the thickness of the wafer, while the probe contacting the chuck is used to monitor the reference position of the work chuck. Additionally or alternatively, one or more IR sensors or other types of sensors can be used to measure the thickness of the wafer, such as when the surface is not too rough.

14. The grind module extends the coarse wheel, rotates the work chuck and grind wheel, dispenses coolant onto the wafer, and feeds the grind wheel into the wafer (step 440). Since rapid impact of the grind wheel onto the wafer surface is typically detrimental to the wafer and wheel, a close-approach device/method can be implemented to approach the wafer rapidly, and warn the tool when the wheel is close to the wafer, then slow the approach for the last few microns. The coarse grind proceeds using parameters defined in the chosen recipe. In some instances, the fast approach occurs from the up position down to a "hover height," which is about 50 μm above the wafer, with the speeds during the fast approach being about 1 mm/sec. The wheel approach can then be slowed, for example to about 5-10 μm/sec. To determine the hover height, the system can, in some instances, first reference the chuck with the grind wheel, which can occur for example during an initial start up of the tool. In some implementations, the tool can be loaded with a reference wafer and the grind wheel lowered until it touches, as evidenced by the load cell force measured on the wafer. The positioning, distance of travel and/or other relevant parameters can be stored or recorded and used to determine hover height. The system can then adjust the relevant hover height automatically to account for wheel wear and/or other factors (e.g., wafer height variations, etc.). The location of the chuck and/or grind wheels (e.g., diamond wheels) are known with respect to each other from reference and/or by previously ground wafer, within several to a few or less microns.

15. During the grinding process, feedback from one or more sensors or probes (e.g., the contact measurement probes, grinding force, grind wheel in-feed rate, and the like) is monitored to determine the cutting efficiency and/or thickness of the wafer (step 442). In some embodiments, when the cutting efficiency drops below a predefined threshold or otherwise becomes inadequate, a wheel dressing assembly can be activated to improve the feed rate or reduce the grinding force by exposing new abrasive on the grind wheel. Alternately, feed rate may be decreased to maintain constant force. The cycle is terminated upon reaching the target thickness amount and/or threshold specified in the recipe and typically associated with the coarse grinding (step 444). Again, one or more contact probes and/or the IR probe can be used while grinding to determine thickness of the wafer. As described above, a probe can contact the wafer to calculate the thickness of the wafer, while a probe contacts the work chuck to monitor the reference position of the work chuck (e.g., to compensate for any change at the work chuck, such as due to thermal expansion or other such shift), which allows for compensation in grinding based on a determined thickness of the wafer and variation in the work chuck. Additionally or alternatively, one or more IR sensors or other types of sensors can be used to calculate the thickness of the wafer, such as when the surface is not too rough.

16. After coarse grind is complete the coarse wheel is raised to a safe vertical position, and the coarse wheel is retracted (step 446).

17. The rotary indexer indexes the work chuck to the fine grind position (return to step 434), when fine grinding is to be performed.

18. The grind module rotates the work chuck and grind wheel, dispenses coolant onto the wafer, and feeds the fine grind wheel into the wafer (step 440). Again, since rapid impact of the grind wheel onto the wafer surface is typically detrimental to the wafer and wheel, a close-approach device/ method can be implemented to approach the wafer rapidly but warn the tool when the wheel is close to the wafer, then slow the approach for the last few microns. The fine grind proceeds using parameters defined in the chosen recipe.

19. During the grinding process, feedback from one or more sensors or probes (the contact wafer thickness measurement probes and/or IR sensor(s), grinding force, grind wheel in-feed rate, and the like) are monitored to determine the cutting efficiency (step 442). When the cutting efficiency becomes inadequate, the wheel dressing assembly might be activated to improve the feed rate or reduce the grinding force by exposing new abrasive on the grind wheel. Alternately, feed rate may be decreased to maintain constant force. The cycle is terminated upon reaching the target thickness amount specified in the recipe.

20. When final thickness or removal amount and/or threshold is achieved (step 444), the fine grind wheel is raised to a safe vertical position (step 446).

21. In some embodiments, the rotary indexer may be indexed to position the work chuck in the edge grind position (step 450).

22. The grind module may, in some implementations, perform an edge grind process (step 452) as defined in the chosen recipe. Some processes may implement the edge grinding prior to one or both the coarse and fine grinding. The order of grind steps can be recipe configurable. Further, the edge grinding may be implemented similar to the edge grinding described in U.S. Pat. No. 7,458,878, which is incorporated herein by reference. Additionally, the edge grinding may be implemented at least in part through cooperative movement of the wafer chuck, rotary indexer and/or feed of the grind wheel into contact with the wafer edge.

23. After the grinding processes are completed, the grind wheel is raised to a safe vertical position (step 454). In some instances, the work chuck rotation speed may be increased while water is dispensed onto the surface of the wafer. This removes residual grind swarf from the wafer (step 456).

24. The rotary indexer is indexed to position the work chuck in the load/unload position (step 458). The grind chamber lid is opened.

25. The wet robot 316 positions the end effector above the wafer to pick up the wafer from the work chuck (step 460). The lower spindle turns off the vacuum, and in some instances may produce a reverse air force and inject a relatively small amount of air into the work chuck to assist the release of the wafer from the work chuck.

26. The wafer is transported by the wet robot to the Spin-Rinse-Dry station (SRD) 324. The SRD dries the wafer as defined in the chosen recipe (step 462).

27. The grind chamber lid closes to allow cleaning of the work chuck by clean water, brushes, stone, blade scraping and/or other relevant cleaning (step 464).

28. After the spin rinse dry cycle has been completed, the dry robot 317 picks the wafer from the SRD using an end effector.

29. The ground and dried wafer is then placed back in a cassette (step 466).

30. The cycle is repeated for any number of wafers in one or more cassettes (return to step 414). In some instances, the process may be implemented on multiple wafers in a parallel manner, utilizing the grind modules 312-314 to maximize throughput of the grind system. Multiple grind modules 312-314 can, in at least some implementations, significantly increase the throughput of the tool.

Grinding Stacked Substrates

For stacked silicon wafer applications that are commonly employed, such as for the manufacture of back side illuminated (BSI) image sensors and 3-D interconnects (IC) for computer chips, other grinding processes may alternatively be implemented. The device wafer (which is the top wafer being ground) is the wafer of interest, while the bottom one or more wafers or other such substrate is a "carrier-wafer" used to provide a sturdy support for the device wafer, which is ground to a desired thickness, and often an extreme thinness of typically less than 50 microns. The device wafer and the carrier wafer can be cooperated or bonded, such as with adhesives or without adhesives using Van der Waals forces. Both the device wafer and carrier wafer have thickness and uniformity variations from nominal. Therefore, it is critical to be able to discern the thickness of the device wafer discreetly from the carrier wafer during grinding to so that the process can be stopped at the correct thickness amount. Apparatuses and methods that have been developed to account for issues arising from stacked wafer configurations are described below.

Some embodiments account for carrier wafer thickness. In some instances, the automated grinding platform is outfitted with additional sensors or metrology that can measure the thickness of the device wafer before and/or during grinding Infrared laser thickness sensors employing interferometrical methods can be used for this task. This "sensor" can comprise an IR light source and detector connected via fiber optic cable to a lens assembly mounted in a lens housing. In some embodiments, the lens housing is positioned just above or below the wafer to be measured, so that it may have an unhindered view of the wafer surface. A controller and/or computer controls and deciphers the information from lens assembly, as read by the detector.

One or more IR sensors may be placed in the pre-align station 320, in a separate metrology station and/or in the grind module to calculate the thicknesses of incoming device wafer, carrier wafer and/or both. The thickness information can be stored and utilized later when a grind module is grinding the device wafer. Since the grind module, in some embodiments, uses one or more contact probes to measure the thickness of the wafer stack during grinding, simple arithmetic can then be used to calculate the nominal thickness of the device wafer in real time (with the carrier wafer thickness being known).

Additionally or alternately, one or more IR sensors can be integrated directly into the grind engine and can monitor the device wafer thickness in real time during grinding. In some instances, an IR sensors may not be able to accurately measure the thickness of the device wafer when the surface is too rough (such as during the coarse grind step). But the IR sensor typically can measure the device wafer thickness during the fine grind step. So the contact probe may be employed to monitor wafer stack thickness during the coarse grind while the IR sensor is used during the fine grind step to discreetly measure the device wafer thickness.

In some embodiments, the lens of the IR sensor is spaced a short distance from the surface of the wafer (e.g., about 5-100 mm away, in some instances 20 mm away). The grind swarf generated during grinding can impede the line of sight between the lens and the wafer. To remedy this, the lens housing can in some implementations be mounted in another tubular housing, closed on one end, and open on the other. The IR sensor lens "looks" down through the open end of the tubular housing, which is positioned such that it faces the surface of the wafer to be ground and measured. The tubular housing is also connected to a pressurized fluid source, such as pressurized water or air, such that when the fluid is injected into the tubular housing between the lens and the open end, the fluid ejects from the open end. The pressurized fluid clears grind swarf out of the way, creating a clean line of sight for the IR sensor to view the surface of the wafer during grinding.

Additionally, the ejecting fluid can be used to create a hydrodynamic bearing beneath the device so that it may float on the rotating wafer during grinding, rather than affixing it to a solid surface. The advantage of using this hydrodynamic method is that the height of the device need not be adjusted to the height of the grind chuck. The hydrodynamic bearing provides for uniform, consistent gap between device and wafer. The hydrodynamic IR sensor housing apparatus and measuring method are described in patent application Ser. No. 13/291,800, which is incorporated herein by reference.

Some embodiments can account for a shape of the carrier wafer. Carrier wafer shapes commonly vary from nominal, wafer to wafer. The shape of the carrier wafer can impart undesirable shapes into the device wafer during grind. For instance, if the carrier wafer has a concave upper surface, the device wafer could be ground to convex shape, assuming the grind spindle has been aligned to grind perfectly flat. Accordingly, some embodiments take into account the shape of the carrier wafer as measured by the grind system or another device and/or obtained from another source (e.g., third party supplier).

In some instances, multiple IR sensors or one IR sensor mounted to a movable arm may be used at the pre-aligner or a separate station to pre-measure the shape of the carrier wafer by measuring it at multiple locations. The pre-measure can, in some instances, additionally or alternatively measure a thickness of the carrier wafer. In other embodiments, the one or more IR sensors can be mounted in the grind chamber itself of the grind module for measuring the carrier wafer shape and/or shape and/or thickness of a wafer to be ground. A combination of coordinated rotary indexer and/or chuck motion can enable detailed mapping of the wafer thickness and/or carrier wafer in the grind chamber using a single IR sensor mounted above the wafer at a desired position, such as corresponding to a center of the wafer. The grind module can then use the carrier wafer shape information (e.g., mapping) in combination with grind spindle alignment hardware and computer algorithms to calculate and enact a new grind spindle or work chuck spindle position (e.g., pitch and yaw) that will reduce and/or nullify the affects of the carrier shape on the grinding of the device wafer grinding semiconductor wafers stacked on a carrier wafer and adaptive autoshape control. Similar mapping can be performed of the work chuck upon which the wafer and/or carrier-wafer are positioned. This mapping of the work chuck can be used in cooperate with the mapping of the surface of the carrier-wafer upon which the wafer of interest is positioned during grinding. The grind module can then cooperatively use the carrier wafer shape and work chuck shape in determining and/or modify the grinding and/or grind recipe, which can result in a modification of the grinding in accordance with the mapping. For example, the grind recipe can include grind spindle and/or work chuck spindle positioning (e.g., pitch and yaw) and/or amounts of grinding in relative locations along the surface of the device wafer. In some embodiments, mapping of the carrier wafer is obtained from a source (e.g., supplier of the carrier wafer) and/or mapped through a separate system or separate metrology (e.g., performed in a front end module).

Figure 5:
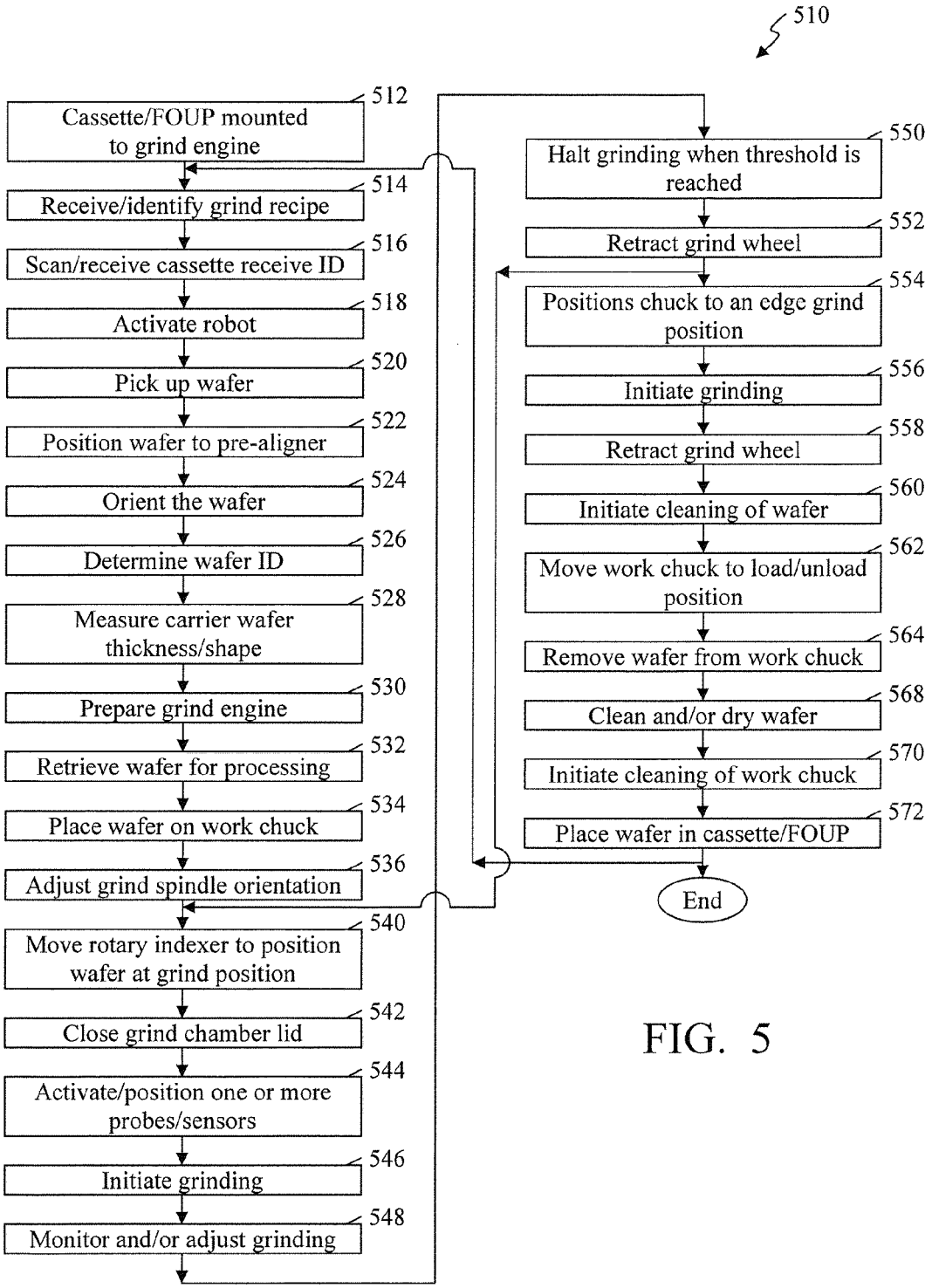
FIG. 5 shows a simplified flow diagram of a process, in accordance with some embodiments, for use in grinding stacked semiconductor wafers.

Below is described and FIG. 5 shows a simplified flow diagram of a process 510 according to some embodiments for use in grinding stacked semiconductor wafers. In some implementations, an automated wafer grind system can be largely similar to the methods described above for non-stacked wafers, but have been augmented with the additional metrology and control as described below.

1. One or more cassettes or FOUPs of wafers are loaded into a cassette I/O device mounted to the EFEM of the grinding system (step 512). One or more empty cassettes may also be loaded as output (or "receive") cassettes for some configurations.

2. An operator or factory host specifies a recipe to be used for grinding and a "flow" (or wafer path) through the grind system (step 514).

3. The dry robot 317 can use a scanning device to scan the input and output cassette(s) for wafer presence (step 516). Alternatively, the cassettes can be scanned by the cassette I/O device (for example, FOUP loadports can have integrated wafer scanning capability).

4. The dry robot 317 uses an end effector to pick up a wafer, for example from the bottom-side, from the input cassette and withdraws the wafer from the cassette and moves the wafer into the EFEM (step 518).

5. The wafer is moved to a position, and may be repositions where the wafer is rotated 180° resulting in the end effector on top of the wafer (step 520).

6. The wafer is placed by the dry robot onto a chuck of the pre-aligner 320 (step 522).

7. Pre-aligner can center (or finds the center of) and may orient the wafer to a user-defined angle relative to the end effector pick direction (step 524). The wafer ID, if present, may also be read by the wafer, the OCR or otherwise identified during the pre-aligning process (step 526).

8. A carrier wafer thickness and/or shape are measured (step 528). In some instances, the carrier wafer is measured at the pre-aligner 320, for example, using an IR wafer thickness sensor with wafers that are at least partially transparent to the selected IR frequency. The measurement data is stored by a controller (e.g., a controlling computer) for use during the subsequent grinding process. Alternatively, the dry or wet robot may place the wafer into a separate station for measuring the shape and thickness of the carrier wafer, which in at least some instances measures the entire wafer. In yet other embodiments, the carrier wafer may be measured in the grind module itself, as described in Step 12 below. Some embodiments download or access a memory storage that stores the carrier thickness and/or shape data to the grinder. For example, the carrier may be measured by a device outside the grind system and provided to the grind system, obtained from a third party or otherwise obtained.

9. In some embodiment, during the pre-align process, the grind module prepares for the wafer (step 530). For example, the top surface of the work chuck can be cleaned with a work chuck cleaning assembly of the grind system; a rotary indexer indexes the work chuck to the grind position, and two contact probes reference the top of the work chuck; the rotary indexer indexes the work chuck to the load/unload position; the work chuck may be indexed to a desired orientation (e.g., recipe or user-defined orientation); and the grind chamber lid can be opened.

10. The wet robot 316 picks the wafer from the pre-aligner 320 or metrology station using an end effector (step 532).

11. The wet robot 316 places the wafer on top of the work chuck in a grind module 312-314 (step 534). A vacuum can be pulled through the porous surface of the work chuck to seat and hold the wafer. The wet robot end effector releases the wafer and retracts from the grind module.

12. In some embodiments, when the carrier wafer and/or a surface shape or thickness mapping of the wafer of interest is to be measured in the grind chamber, the rotary indexer indexes to position the wafer beneath the IR wafer thickness sensor. The IR sensor can, in some instances, be positioned such that it coincides with the center of the wafer. The rotary indexer is moved while the sensor is active such that the wafer thickness is monitored to create a diametrical scan ("diameter scan") of the carrier wafer and/or wafer of interest. Alternatively, the rotary indexer and work chuck rotation may be moved in a coordinated motion to create a polar or Cartesian (x and y axis type) map of the carrier wafer and/or wafer of interest. The measurement data is stored by the controlling computer for use during the subsequent grinding process, which can cause modification to the grinding and/or grind recipe. For example, the grinding recipe may be modified in accordance with the mapping of the carrier wafer and/or the surface of the carrier wafer, and/or the grind spindle alignment, which may be defined within the grinding recipe may be adjusted in accordance with the mapping. The mapping of the surface of the carrier wafer may alternatively or additionally be provided by a third party or measured in a separate device or separate portion of the grind system.

13. In those embodiments where automatic and adaptive shape control techniques are being used, the grinding and/or grind recipe can be modified based on one or more of the mapping of the work chuck, the carrier wafer and/or thickness of the wafer to be ground. For example, the grind spindle pitch and yaw may be repositioned to produce desired post-grind device wafer shape (step 536). For example, in some embodiments the grind module comprises one or more grind spindle adjustment screws that cooperate with an upper grind spindle (e.g., three adjustment screws located at 120 degrees from one another). These adjustment screws provide for the ability to rigidly position the spindle, yet also align the grind spindle pitch and yaw to the wafer and/or chuck.

14. The rotary indexer indexes the work chuck to the coarse grind position (step 540), which typically includes rotating the work chuck through a partial rotation of the rotary indexer to the grind position.

15. The grind chamber lid is closed (step 542).

16. One or more probes are positioned and/or activated, such as contact probes being lowered, one contacting on the wafer and the other on the exposed area of the work chuck (the non-porous outer diameter portion of the work chuck) (step 544). The probe contacting the wafer can be used to calculate the thickness of the wafer, while the probe contacting the work chuck can be used to monitor the reference position of the work chuck. Additionally or alternatively, an IR sensor can be used to calculate the thickness of the wafer when the surface is not too rough.

17. The grind module extends the coarse wheel, rotates the work chuck and grind wheel, dispenses coolant onto the wafer, and feeds the grind wheel into the wafer (step 546). Since rapid impact of the grind wheel onto the wafer surface typically is detrimental to the wafer and wheel, a close-approach device/method can be implemented to approach the wafer rapidly but warn the tool when the wheel is close to the wafer, then slow the approach for the last few microns. The coarse grind proceeds using parameters defined in the chosen recipe.

18. During the grinding process, feedback from the contact measurement probes, grinding force, grind wheel in-feed rate and/or other parameters can be monitored to determine the cutting efficiency (step 548). When cutting efficiency becomes inadequate, the wheel dressing assembly, in some embodiments, can be activated to improve the feed rate or reduce the grinding force by exposing new abrasive on the grind wheel. Additionally or alternately, feed rate may be decreased to maintain constant force. The cycle is terminated upon reaching the target thickness amount or threshold specified in the recipe (step 550).

19. After coarse grind is complete the coarse wheel is raised to a safe vertical position, and the coarse wheel is retracted (step 552).

20. In those implementations where a fine grind is to take place, the rotary indexer indexes the work chuck to the fine grind position (return to step 540). In some embodiments, further adjustments to grind spindle orientation may be implemented (step 536).

21. The grind module rotates the work chuck and grind wheel, dispenses coolant onto the wafer, and feeds the fine grind wheel into the wafer (step 546). One or more sensors/probes are activated and/or continue to be active relative to the wafer, carrier wafer and/or work chuck (step 544). In some instances, the one or more sensors may be repositioned. Since rapid impact of the grind wheel onto the wafer surface is typically detrimental to the wafer and wheel, a close-approach device/method can be implemented to approach the wafer rapidly but warn the tool when the wheel is close to the wafer, then slow the approach for the last few microns. The fine grind proceeds using parameters defined in the chosen recipe.

22. During the grinding process, feedback from the wafer thickness measurement probes and/or IR sensor, grinding force, grind wheel in-feed rate and/or other parameters are monitored to determine the cutting efficiency (step 548). When the cutting efficiency becomes inadequate, the wheel dressing assembly can be activated to improve the feed rate or reduce the grinding force by exposing new abrasive on the grind wheel. Alternately, feed rate may be decreased to maintain constant force. The cycle is terminated upon reaching the target thickness amount specified in the recipe. Additionally, during grinding the sensors and/or probes (e.g., contact type probe) can be used to determine final thickness and/or whether the thickness is within a threshold. The controlling computer can use contact type probe information, arithmetic and/or stored carrier thickness data to determine device wafer thickness. Similarly, when the IR type probe is used to determine final thickness, the controlling computer can directly use the IR probe thickness data.

23. When final thickness is achieved the grinding is halted (step 550), and the fine grind wheel is raised to a safe vertical position (step 552).

24. The rotary indexer may be indexed to position the work chuck in the edge grind position (step 554).

25. The grind module may perform the edge grind process (step 556) as defined in the chosen recipe. In some instances, the edge grinding may occur prior to the coarse and/or fine grinding. The order of grind steps will be recipe configurable. The edge grinding may be implemented through a cooperated movement of the rotary indexer and the grinder used to grind the edge (e.g., feed adjustment). The grinder may be one of the coarse or fine grind wheels or a separate edge grinder.

26. After the grinding processes are completed, the grind wheel is raised to a safe vertical position (step 558). The work chuck rotation speed may be increased while water and/or one or more chemicals is dispensed onto the surface of the wafer (step 560). This removes residual grind swarf from the wafer.

27. The rotary indexer is indexed to position the work chuck in the load/unload position (step 562). The grind chamber lid is opened.

28. The wet robot 316 positions the end effector above the wafer to pick up the wafer from the work chuck. The lower spindle turns off the vacuum, and in some instances injects a small amount of air into the work chuck to assist the release of the wafer from the work chuck (step 564).

29. The wafer is transported by the wet robot to the SRD 324. The SRD dries the wafer as defined in the chosen recipe (step 568).

30. The grind chamber lid closes to allow cleaning of the work chuck by clean water, brushes, stone, blade scraping and/or other such methods (step 570).

31. After the spin rinse dry cycle has been completed, the dry robot 317 picks the wafer from the SRD using an end effector.

32. The ground and dried wafer is then placed back in the cassette (step 572).

33. The cycle can be repeated for any number of wafers in the cassette, and in some instances can be implemented in a parallel manner, utilizing multiple grind modules 312-314 to improve throughput of the grind system. Multiple grind modules thus significantly increase the throughput of the tool.

Grinding Prime Hard Substrates

Some embodiments further provide for the grinding used during the manufacture of prime silicon and for hard substrate wafers (e.g., silicon dioxide, sapphire, silicon carbide, Silicon Nitride, and other such hard substrates), such as for use as substrates in the manufacture of LED devices. Other hard materials that may be ground include AlTiC (Aluminum-Titanium-Carbide), which is a hard material used as a substrate in the manufacture of Giant Magnetoresistive (GMR) read/write heads (typically used in hard disk drives).

Sapphire wafers used for LED's are typically thinned from about 800 um to about 650 um thick. In some embodiments, one of the goals in grinding (and when relevant subsequent polishing) is to eliminate slicing damage that may occur when sawing the wafer from the boule, while removing as little material as possible, producing a flat, smooth, and useable surface. Grinding can be used in lieu of alternative surfacing operations such as double-side lapping, and it has advantages over lapping, such as immunity to incoming wafer thickness variations.

In some instances, the wafers are typically cut from large, cylindrical boules using a sawing process that leaves undesirable rough saw lines in the wafer substrates. Grinding removes these saw lines and leaves a surface ready for final polish. However, the chucking process, which uses vacuum to pull the wafer backside solidly against the porous vacuum chuck during grinding, can cause the saw lines from the backside of the wafer to mirror (or show) through. Once the wafer is released from the chuck, the flat, uniform ground surface shows the imperfections from the backside sawed surface. As such, soft chucking methods are employed in some embodiments for grinding the first side of the wafer. Soft chucking methods were previously described by Strasbaugh in U.S. Pat. No. 5,964,646, incorporated herein by reference. After the first side is ground using the soft chuck method, the wafer can be flipped and ground on a conventional hard chuck. For some processes, the wafer may be flipped one more time to re-grind the original surface flat and parallel with the other side.

Some present embodiments provide grind module designs that allow for an additional grind spindle and chuck to be mounted to the rotating rotary indexer. In some of these arrangements, there are two grind chucks located about 180 degrees from one another. One of the chucks can be set up as a soft chuck, while the other is a hard chuck type. Using this configuration, the soft and hard chuck grinding can both occur in the same grind module.

Additionally or alternatively, some embodiments further employ post-grind stress relieving. Another common problem when grinding hard materials, such as when applying a high down force using diamond abrasives, is that the surfaces left on the wafer by grinding (or a thin layer beneath the ground surface) may be too damaged to permit safe removal of the wafer from the chuck. The damage below the surface is commonly referred to as "sub-surface damage" or "SSD." When surface damage and SSD are too severe, de-chucking (releasing the work chuck wafer holding vacuum) may cause the wafer to bow severely or even break altogether. On-chuck stress relieving techniques can be used to reduce or eliminate surface and sub-surface damage to an acceptable level prior to de-chucking. Polishing (which in some instances can be the preferred method) and etching processes are commonly used to eliminate the damage. Additionally or alternatively, some embodiments implement polishing to achieve a more uniform surface. For example, with some wafers, such as LED wafers, the backside has to have a relatively uniform roughness. The grinding, however, can cause non-uniform roughness (e.g., center to edge). As such, the polishing can reduce this non-uniform roughness, such as with LED wafers achieving a relative uniform roughness of within about 1-2 μm or less.

In some embodiments, the grind system and/or grinding platform may be outfitted with a polishing arm that can reach into the grind module. The polishing arm is equipped with an end effector that affixes a polishing pad or lapping device with fixed or loose abrasive and a nozzle to dispense a polishing fluid such as slurry with suspended abrasive particles. Slurry is dispensed through a hole(s) in the pad, or from a source above the wafer and off to one side of the polish pad. The polishing pad may be free-rotating or rotated under power. The arm is equipped with hardware to allow it to press the pad against the wafer with force. The wafer is rotated by the work chuck while being polished. Some of this technology has been previously described by U.S. Pat. Nos. 6,602,121, 6,379,235, 6,511,368, 6,527,621, 6,945,856, 6,464,574, 6,547,651, 6,692,339, 6,361,647, 6,227,956, 6,887,133, 6,450,860, 6,514,129, 6,517,419, 6,514,121, 6,495,463, 6,629,874, 6,346,036, 6,855,030, and 6,551,179 (Model 6EJ), which are incorporated herein by reference.

Further, some embodiments provide a rotary indexer design that allow for convenient positioning of the wafer under the polishing arm after grinding. The rotary indexer also allows for oscillation of the wafer beneath the polishing pad, without the need to have separate hardware on the arm to accomplish this. Oscillation is commonly used in polishing for a more uniform finish and uniform removal of material. It also allows the polishing pad to be smaller than the wafer, if desired, while still contacting the entire wafer surface via the oscillation. This is called "sub-aperture polishing."

Additionally or alternatively to polishing, an acid or base etching process may be used to remove the damaged wafer surface. For etching, the rotary indexer will move to a position beneath a chemical dispense nozzle. The etching chemical (e.g. hot KOH) will be dispensed on the surface of the wafer. During the chemical dispense period, the wafer chuck may be rotated and the rotary indexer may be oscillated to achieve desired distribution of the chemistry over the wafer surface. On chuck chemical etching has been previously described by U.S. Pat. No. 7,160,808 by Strasbaugh, which is incorporated herein by reference. The wafer can be polished or etched on the chuck until enough damage is removed to permit safe handling of the wafer once released from the chuck or to a requested or specified roughness. Typically this is about 3 to 5 microns of removal.

It is noted that for at least some hard substrates, such as those used for LED's, it is common to surface the wafers using batch-type processes, processing multiple wafers at one time. Batch double-side polishing and lapping processes often require laborious pre-sorting of wafers by thickness.

The present embodiments, however, allow for single wafer in-feed grinding, as described above, and are typically immune to incoming wafer thicknesses, and can grind the wafers to common thickness. Accordingly, some embodiments allow for the grinding of non-uniform thickness hard substrate wafers to a common thickness without the need to pre-sort.

Figure 6:
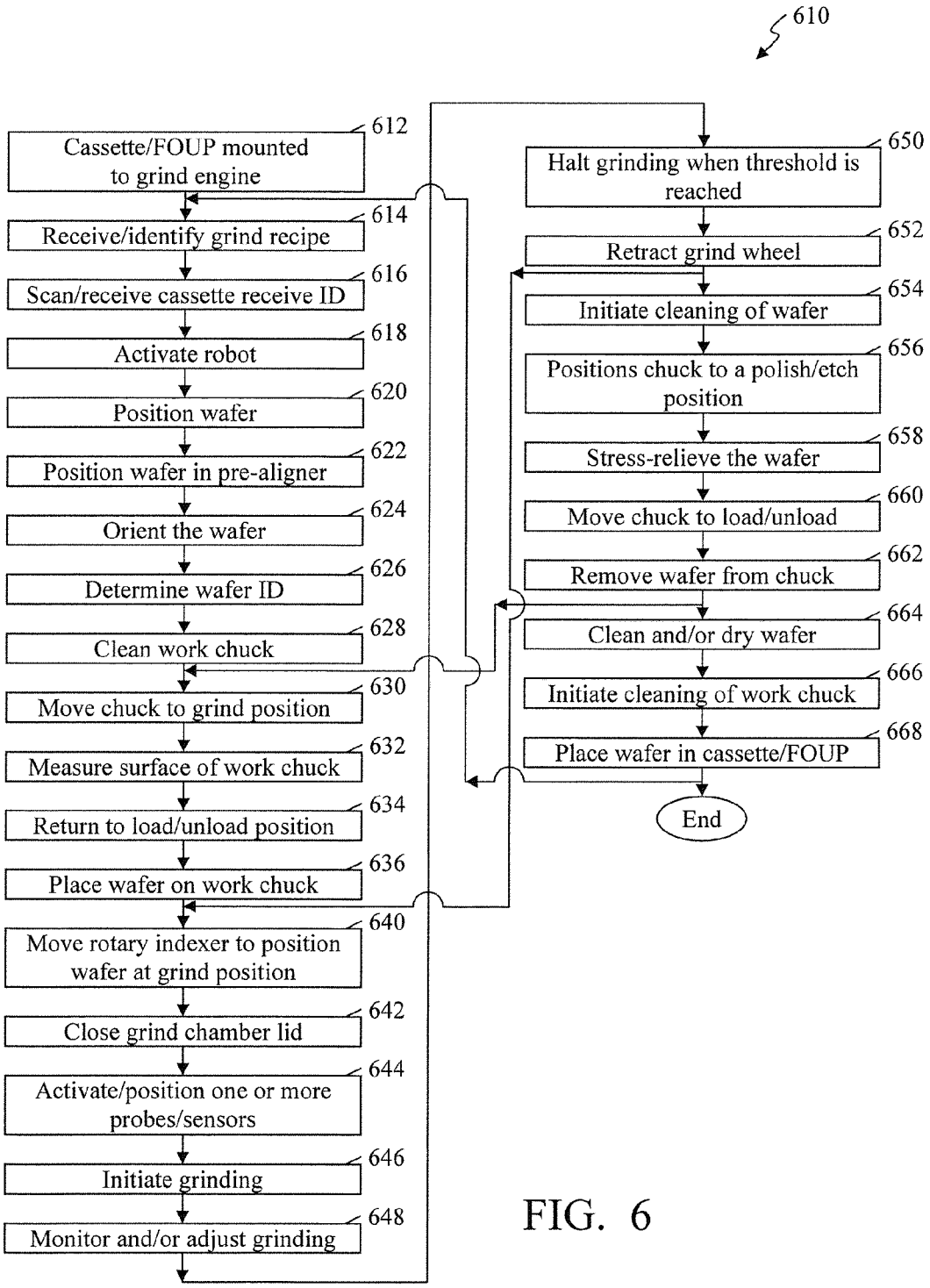
FIG. 6 shows a simplified flow diagram of a process, in accordance with some embodiments, in providing grinding of prime substrate wafers.

Below is described and FIG. 6 shows a simplified flow diagram of a process 610, in accordance with some embodiments, in providing grinding of prime substrate wafers. The process below is described a process method where one or more grind modules are equipped with two grind chuck spindles, one with a soft chuck and one with a hard chuck. In other embodiments, however, the soft and hard chucks may also be separated into separate grind modules, if desired (e.g., grind module 1: 2 soft chucks, grind side 1; grind module 2: 1 hard chuck, grind side 2; grind module 3: 1 hard chuck, regrind side 1), which can be configurable and dictated by throughput of each step.

1. A one or more cassettes of substrates (e.g., wiresawn wafers) is loaded into a cassette I/O device mounted to the EFEM of the grinding system (step 612). One or more empty cassettes may need to also be loaded as output cassettes for some configurations.

2. An operator or factory host specifies a recipe to be used for grinding and a flow through the grinding tool (step 614).

3. The dry robot 317 uses a scanning device to scan the one or more input and output cassettes for wafer presence (step 616). Alternatively, the cassettes can be scanned by the cassette I/O device (for example, FOUP loadports typically have integrated wafer scanning capability).

4. The dry robot 317 uses an end effector to pick up a wafer, for example from the bottom-side from the input cassette, and withdraw the wafer from the cassette and into the EFEM (step 618).

5. The wafer is moved to a desired position, and in some instances can include rotating the wafer 180° resulting in the end effector on top of the wafer (step 620).

6. The wafer is placed by the dry robot onto the pre-aligner chuck 320 (step 622).

7. The pre-aligner centers (or finds the center of) and may orient the wafer to a recipe or user defined angle relative to the end effector pick direction (step 624). The wafer ID, if present, may also be read by the OCR during the pre-aligning process (step 626).

8. During the pre-align process, the grind module prepares for the wafer. A top surface of the soft work chuck is cleaned with the work chuck cleaning assembly (step 628), for example, using a soft brush that does not damage the soft surface. The rotary indexer indexes the work chuck to the grind position (step 630), and one or more probes or sensors (e.g., the two contact probes) reference the top of the work chuck (step 632). One of the probes can reference the hard outer diameter of the chuck, while the other probe can reference on the soft part of the chuck. Although the soft surface does not provide an optimal surface for referencing, the measurement typically is reliably repeatable, and can be used for a "Delta" type grind, which is described below in Step 15. The rotary indexer indexes the soft work chuck to the load/unload position (step 634). The soft work chuck may be indexed to a recipe or user defined orientation. The grind chamber lid is opened.

9. The wet robot 316 picks the wafer from the pre-aligner 320 using an end effector.

10. The wet robot 316 places the wafer on top of the soft work chuck in the grind module 312 (step 636). A vacuum is pulled through the porous surface of the soft work chuck to seat and hold the wafer against the chuck. The wet robot end effector releases the wafer and retracts from the grind module.

11. The rotary indexer indexes the work chuck to the coarse grind position (step 640).

12. The grind chamber lid is closed (step 642).

13. One or more probes and/or sensors can be utilized to monitor thickness (step 644). For example, a first contact probe can be positioned to be in contact on the wafer and a second probe on an exposed area of the work chuck (e.g., the non-porous outer diameter portion of the work chuck). The first probe can be used to calculate the thickness of the wafer, while the second probe can be used to monitor the reference position of the work chuck. Additionally or alternatively, an IR sensor can be used to calculate the thickness of the wafer when the surface is not too rough.

14. The grind module extends the coarse wheel, rotates the work chuck and grind wheel, dispenses coolant onto the wafer, and feeds the grind wheel into the wafer (step 646). Since rapid impact of the grind wheel onto the wafer surface is typically detrimental to the wafer and wheel, a close-approach device/method can be implemented to approach the wafer rapidly but warn the tool when the wheel is close to the wafer, then slow the approach for the last few microns. The coarse grind proceeds using parameters defined in the chosen recipe.

15. During the grinding process, feedback from the contact measurement probes, grinding force, grind wheel in-feed rate and/or other parameters can be monitored to determine the cutting efficiency (step 648). If cutting efficiency becomes inadequate, a wheel dressing assembly might be activated to improve the feed rate or reduce the grinding force by exposing new abrasive on the grind wheel. Alternately, feed rate may be decreased to maintain constant force. The cycle can be terminated upon reaching the removal amount or coarse grind threshold specified in the recipe (rather than a target thickness) (step 650). This is known as a "Delta grind" or when a target thickness is achieved.

16. After the coarse grind is complete the coarse wheel is raised to a safe vertical position, and the coarse wheel is retracted (step 652).

17. The rotary indexer indexes the work chuck to the fine grind position (return to step 640) when fine grinding is to occur.

18. The grind module rotates the work chuck and grind wheel, dispenses coolant onto the wafer, and feeds the fine grind wheel into the wafer (step 646) while sensors/probes are active (step 644). Since rapid impact of the grind wheel onto the wafer surface is typically detrimental to the wafer and wheel, a close-approach device/method can be implemented to approach the wafer rapidly but warn the tool when the wheel is close to the wafer, then slow the approach for the last few microns. The fine grind proceeds using parameters defined in the chosen recipe.

19. During the grinding process, feedback from the wafer thickness measurement probes and/or IR sensor, grinding force, grind wheel in-feed rate and/or other parameters can be monitored to determine the cutting efficiency (step 648). If cutting efficiency becomes inadequate, the wheel dressing assembly might be activated to improve the feed rate or reduce the grinding force by exposing new abrasive on the grind wheel. Alternately, feed rate may be decreased to maintain constant force. The cycle is terminated upon reaching the removal amount or fine grind threshold specified in the recipe (rather than a target thickness) (step 650). Some implementations may further employ rotary indexer oscillation and/or work chuck speed changes, which may in part provide more uniform surface finish.

20. After fine grind is complete the grind wheel is raised to a safe vertical position.

21. The work chuck rotation speed may be increased while water is dispensed onto the surface of the wafer (step 654). This removes residual grind swarf from the wafer.

22. In some implementations, the rotary indexer is indexed to position the work chuck in polishing (or etch) position (step 656). The wafer can be stress-relieved via polishing or etching methods (step 658).

23. The rotary indexer is indexed to position the work chuck in the load/unload position (step 660). The grind chamber lid is opened.

24. The wet robot 316 positions the end effector above the wafer to pick up the wafer from the soft work chuck. The lower spindle turns off the vacuum, and in some implementations, injects a small amount of air into the soft work chuck to assist the release of the wafer from the work chuck (step 662).

25. The grind module and wet robot prepare for the wafer to be placed on the second (hard) work chuck. The rotary indexer indexes the second (hard) work chuck to the grind position (return to step 630), and one or more sensors (e.g., one or more contact probes) can be used to reference the top of the work chuck (step 632). The rotary indexer is indexed to position the second (hard) work chuck in the load/unload position (step 634). It is noted that is some instances the second work chuck may be cleaned prior to the wafer being positioned on the second work chuck (step 628). This cleaning may be similar to the chuck cleaning described above or below.

26. In some instances, the wet robot 316 places the wafer temporarily in a holding station, and then re-grips the wafer (for example, from the opposite (bottom) side). The wet robot then flips the wafer such that the end effector is on top of the wafer.

27. The wet robot 316 places the wafer on top of the second (hard) work chuck in the grind module (step 636). A vacuum force is applied and pulled through the porous surface of the second work chuck to seat and hold the wafer against the chuck. The wet robot 316 end effector releases the wafer and retracts from the grind module.

28. The rotary indexer indexes the hard work chuck to the coarse grind position (step 640).

29. The grind chamber lid is closed (step 642).

30. One or more sensors and/or probes are positioned and/or activated (step 644). For example, thickness probes or gauges can be lowered, a first on the wafer and a second on the exposed area of the work chuck (the non-porous outer diameter portion of the work chuck). The first probe can be used to calculate the thickness of the wafer, while the second probe can be used to monitor the reference position of the work chuck. Additionally or alternatively, an IR sensor can be used to calculate the thickness of the wafer.

31. The grind module extends the coarse wheel, rotates the work chuck and grind wheel, dispenses coolant onto the wafer, and feeds the grind wheel into the wafer (step 646). Since rapid impact of the grind wheel onto the wafer surface is typically detrimental to the wafer and wheel, a close-approach device/method can be implemented to approach the wafer rapidly but warn the tool when the wheel is close to the wafer, then slow the approach for the last few microns. The coarse grind proceeds using parameters defined in the chosen recipe.

32. During the grinding process, feedback from the wafer thickness measurement probes and/or IR sensor, grinding force, grind wheel in-feed rate and/or other relevant parameters are monitored to determine the cutting efficiency (step 648). If cutting efficiency becomes inadequate, the wheel dressing assembly might be activated to improve the feed rate or reduce the grinding force by exposing new abrasive on the grind wheel. The cycle is terminated upon reaching the target thickness amount and/or threshold specified in the grinding recipe (step 650).

33. After coarse grind is complete the coarse wheel is raised to a safe vertical position, and the coarse wheel is retracted (step 652).

34. The rotary indexer indexes the work chuck to the fine grind position (return step 640) when fine grinding is to be performed.

35. The grind module rotates the work chuck and grind wheel, dispenses coolant onto the wafer, and feeds the fine grind wheel into the wafer (step 646) while one or more sensors and/or probes are active (step 644). Since rapid impact of the grind wheel onto the wafer surface is typically detrimental to the wafer and wheel, a close-approach device/method can be implemented to approach the wafer rapidly but warn the tool when the wheel is close to the wafer, then slow the approach for the last few microns. The fine grind proceeds using parameters defined in the chosen recipe 36. During the grinding process, feedback from the wafer thickness measurement probes and/or IR sensor, grinding force, grind wheel in-feed rate and/or other relevant parameters are monitored to determine the cutting efficiency (step 648). If cutting efficiency becomes inadequate, the wheel dressing assembly might be activated to improve the feed rate or reduce the grinding force by exposing new abrasive on the grind wheel. The cycle is terminated upon reaching the target thickness amount and/or threshold specified in the recipe (step 650).

37. After fine grind is complete the grind wheel is raised to a safe vertical position (step 652).

38. After the grinding processes are completed, the grind wheel is raised to a safe vertical position. The work chuck rotation speed may be increased while water is dispensed onto the surface of the wafer (step 654). This removes residual grind swarf from the wafer.

39. In some embodiments, the rotary indexer is indexed to position the work chuck in polishing (or etch) position (step 656). The wafer can then be stress-relieved via polishing or etching methods (step 658).

40. The rotary indexer is indexed to position the work chuck in the load/unload position (step 660). The grind chamber lid is opened.

41. The wet robot 316 positions the end effector above the wafer to pick up the wafer from the hard work chuck. The lower spindle turns off vacuum and injects a small amount of air into the hard work chuck to assist the release of the wafer from the work chuck (step 662).

42. The wet robot 316 may flip the wafer, and the first side may be ground and stress-relieved again on the hard chuck, as per Steps 27 through 42.

43. The wafer is transported by the wet robot to the SRD 324. The SRD dries the wafer as defined in the chosen recipe (step 664).

44. The grind chamber lid closes to allow cleaning of the hard work chuck by clean water, brushes, stone, blade scraping and/or other relevant methods (step 666).

45. After the spin rinse dry cycle has been completed, the dry robot 317 picks the wafer from the SRD using an end effector.

46. The ground and dried wafer is then placed back in the cassette (step 668).

47. The cycle is repeated for any number of wafers in any number of cassettes, and in some instances, can be implemented in a parallel manner, utilizing multiple grind modules 312-314 to increase throughput of the grind tool. Multiple grind modules thus significantly increase the throughput of the tool.

Backgrinding Hard Substrates

In many applications, backgrinding is performed on substrates, such as on hard substrates having finished LED devices, and often the backgrinding is performed on the surface as a near-final step before singulation. The grinding thins the back side of the wafer to a desired thickness providing for, among other things, better transmission of light from the LED through the substrate. For example, wafers may be thinned, in some implementations, from about 650 um to 100 um thick. Because the wafers are ground so thin, the LED device wafers may be cooperated with a carrier, such as bonded to a carrier wafers, for support.

As with prime hard substrate grinding, stress relieving techniques may be utilized in some implementations to limit or avoid bowing and/or breaking of the wafer, such as during de-chucking. Some embodiments utilize an additional full-aperture polishing as a subsequent step to grinding and stress-relief because a highly polished surface further improves light transmission. Since polishing durations can be very lengthy (e.g., an hour or more) compared with grind duration, the polishing may be performed on separate equipment, which can avoid throughput "bottlenecks" in the grinding machine.

Figure 7:
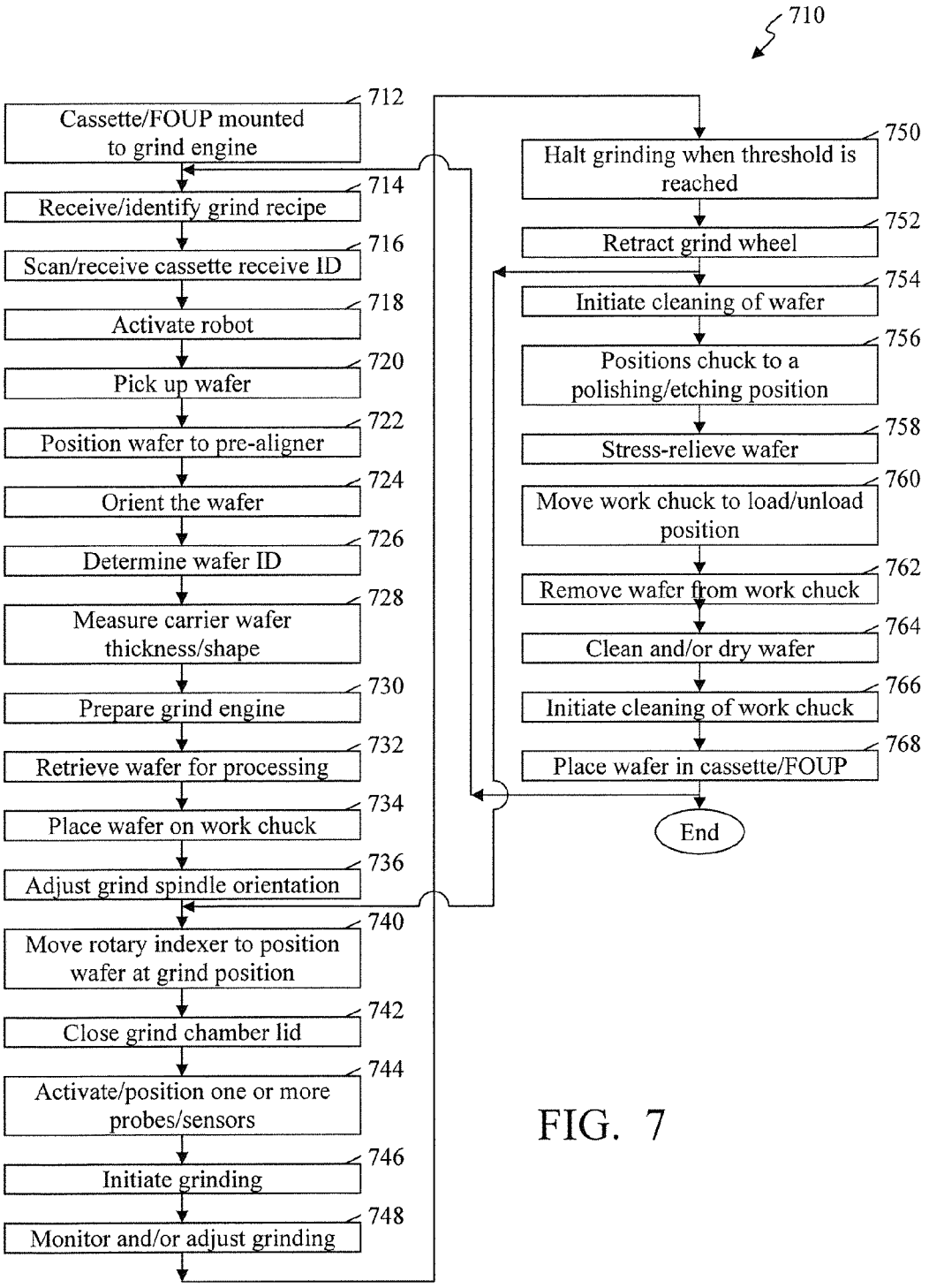
FIG. 7 shows another example of a process used to back grind hard substrates, such as hard substrate wafers, in accordance with some embodiments.

FIG. 7 shows and below is described another example of a process 710 used to back grind hard substrates, such as hard substrate wafers, in accordance with some embodiments.

1. One or more cassettes of wafers are loaded into a cassette I/O device mounted to the EFEM of the automated grinding tool (step 712). The device side of the wafers are often face-up. One or more empty cassettes may also be loaded as output cassettes for some configurations.

2. An operator or factory host specifies a recipe to be used for grinding and a flow through the grind system (step 714).

3. The dry robot 317 uses a scanning device to scan the input and output cassettes for wafer presence (step 716). Additionally or alternatively, the cassettes can be scanned by the cassette I/O device.

4. The dry robot 317 uses an end effector to pick up a wafer, such as from the bottom-side, from the input cassette and withdraw the wafer from the cassette and move the wafer into the EFEM (step 718).

5. The wafer is moved to a desired position, which can include rotating 180° resulting in the end effector on top of the wafer (step 720).

6. The wafer is placed by the dry robot 317 onto the chuck of the pre-aligner 320 (step 722).

7. In some instances, the pre-aligner 320 can center (or find the center of) of the wafer, and may orient the wafer to a recipe or user-defined angle relative to the end effector pick direction (step 724). The wafer ID, if present, may also be read by the OCR during the pre-aligning process (step 726).

8. The carrier wafer thickness and/or shape are measured (step 728), in some embodiments, at the pre-aligner 320, for example by an IR wafer thickness sensor. The measurement data can be stored by the controlling computer for use during the subsequent grinding process. In some instances, the dry robot or the wet robot may alternatively place the wafer into a separate station for measuring. Additionally or alternatively, the carrier wafer may be measured in a grind module 312, as described in Step 12 below. Some sensors, however, may have thickness limitations (e.g., thickness limitations for some IR Sensor types) which may prevent measuring the carrier wafer thickness from the top and through the device wafer. In those cases, the carrier wafer is measured outside the grind module, such as at the pre-aligner 320 or separate station. Further, some embodiments may additionally or alternatively download, to the grind system and/or controller, the carrier thickness and/or shape data from a remote source, such as the factory a supplier or other source.

9. During the pre-align process, one or more of the grind modules 312-314 can be prepared for the wafer (step 730). This can include one or more of the following steps: the top surface of the work chuck can be cleaned with the work chuck cleaning assembly; the rotary indexer can index the work chuck to the grind position, and one or more probes, such as one or more contact probes can reference the top of the work chuck; the rotary indexer can index the work chuck to the load/unload position; the work chuck may be indexed to a recipe, flow and/or user-defined orientation; the grind chamber lid is opened; and/or other such preparations.

10. The wet robot 316 picks the wafer from the pre-aligner 320 using an end effector (step 732).

11. The wet robot 316 places the wafer on top of the work chuck in the grind module (e.g., grind module 314) (step 734). A vacuum is activated and a vacuum force is pulled through the porous surface of the work chuck to seat and hold the wafer. The wet robot 316 end effector releases the wafer and retracts from the grind module.

12. When the carrier wafer is to be measured in the grind chamber, the rotary indexer indexes to position the wafer relative to a sensor, such as beneath the IR wafer thickness sensor. In some embodiments, the IR sensor is positioned such that it coincides with the center of the wafer. The rotary indexer is moved while the wafer thickness is monitored to create a diametrical scan ("diameter scan") of the carrier wafer. Additionally or alternatively, the rotary indexer and work chuck may be moved in a coordinated motion to create a polar or Cartesian (x and y axis type) map of the carrier wafer and/or thickness of the wafer to be ground. The measurement data is stored by the controlling computer for use during the subsequent grinding process.

13. When automatic and adaptive shape control techniques are being used, the grind spindle pitch and yaw may be repositioned to produce desired post-grind device wafer shape (step 736).

14. The rotary indexer then indexes for grinding, typically in accordance with the recipe. In some implementations, the rotary indexer indexes the work chuck to the coarse grind position (step 740).

15. The grind chamber lid is closed (step 742).

16. In some embodiments, one or more probes are positioned and/or activated (step 744). For example, one or more contact probes can be lower relative to the wafer, carrier wafer and/or chuck, such as, one contacting on the wafer and another on the exposed area of the work chuck (the non-porous outer diameter portion of the work chuck). The former probe can be used to calculate the thickness of the wafer, while the latter probe can be used to monitor the reference position of the work chuck. Additionally or alternatively, an IR sensor can be used to calculate the thickness of the wafer if the surface is not too rough.

17. The grinding is initiated (step 746). For example, the grind module extends the coarse wheel, rotates the work chuck and grind wheel, dispenses coolant onto the wafer, and feeds the grind wheel into the wafer. Since rapid impact of the grind wheel onto the wafer surface typically is detrimental to the wafer and wheel, a close-approach device/method can be implemented to approach the wafer rapidly but warn the tool when the wheel is close to the wafer, then slow the approach for the last few microns. The coarse grind proceeds using parameters defined in the chosen recipe.

18. During the grinding process, feedback from the contact measurement probes, grinding force, grind wheel in-feed rate and/or other such parameters are monitored to determine the cutting efficiency (step 748). If cutting efficiency becomes inadequate, the wheel dressing assembly might be activated to improve the feed rate or reduce the grinding force by exposing new abrasive on the grind wheel. Additionally or alternately, feed rate may be decreased to maintain constant force. The cycle is terminated upon reaching the target thickness amount and/or threshold specified in the recipe (step 750).

19. After coarse grind is complete the coarse wheel is raised to a safe vertical position, and the coarse wheel is retracted (step 752).

20. The rotary indexer indexes the work chuck to the fine grind position (return to step 740).

21. The grind module rotates the work chuck and grind wheel, dispenses coolant onto the wafer, and feeds the fine grind wheel into the wafer (step 746). Since rapid impact of the grind wheel onto the wafer surface typically is detrimental to the wafer and wheel, a close-approach device/method can be implemented to approach the wafer rapidly but warn the tool when the wheel is close to the wafer, then slow the approach for the last few microns. The fine grind proceeds using parameters defined in the chosen recipe. In some instances, a single wheel process can be used.

22. During the grinding process, feedback from the wafer thickness measurement probes and/or IR sensor, grinding force, grind wheel in-feed rate and/or other such parameters are monitored to determine the cutting efficiency (steps 944, 948). If cutting efficiency becomes inadequate, the wheel dressing assembly might be activated to improve the feed rate or reduce the grinding force by exposing new abrasive on the grind wheel. Additionally or alternately, feed rate may be decreased to maintain constant force. The cycle is terminated upon reaching the target thickness amount or threshold specified in the recipe (step 750). In some embodiments, when the contact type probe is used to determine final thickness, the controlling computer uses arithmetic and stored carrier thickness data to determine device wafer thickness. Additionally or alternatively, when the IR type probe is used to determine final thickness, the controlling computer can directly use the IR probe thickness data.

23. After fine grind is complete the grind wheel is raised to a safe vertical position (step 752).

24. After the grinding processes are completed, the grind wheel is raised to a safe vertical position. The work chuck rotation speed may be increased while water is dispensed onto the surface of the wafer (step 754). This removes residual grind swarf from the wafer.

25. In some embodiments, the rotary indexer is indexed to position the work chuck in polishing (or etch) position (step 756). The wafer is stress-relieved via polishing or etching methods (step 758).

26. The rotary indexer is indexed to position the work chuck in the load/unload position (step 760). The grind chamber lid is opened.

27. The wet robot 316 positions the end effector above the wafer to pick up the wafer from the work chuck. The lower spindle turns off the vacuum, and in some embodiments injects a small amount of air into the work chuck to assist the release of the wafer from the work chuck (step 762).

28. The wafer is transported by the wet robot 316 to the SRD 324. The SRD dries the wafer as defined in the chosen recipe (step 764).

29. The grind chamber lid closes to allow cleaning of the work chuck by clean water, brushes, stone, blade scraping and/or other such techniques (step 766).

30. After the spin rinse dry cycle has been completed, the dry robot 317 picks the wafer from the SRD using an end effector.

31. The ground and dried wafer is then placed back in the cassette (step 768).

32. The cycle can be repeated for multiple other wafers in the cassette. Some embodiments further implementing grinding in a parallel manner, utilizing all of the grind modules 312-314 to maximize throughput of the tool. Multiple grind modules can thus significantly increase the throughput of the grind tool.

Combined Grinding and Polishing

Figure 8:
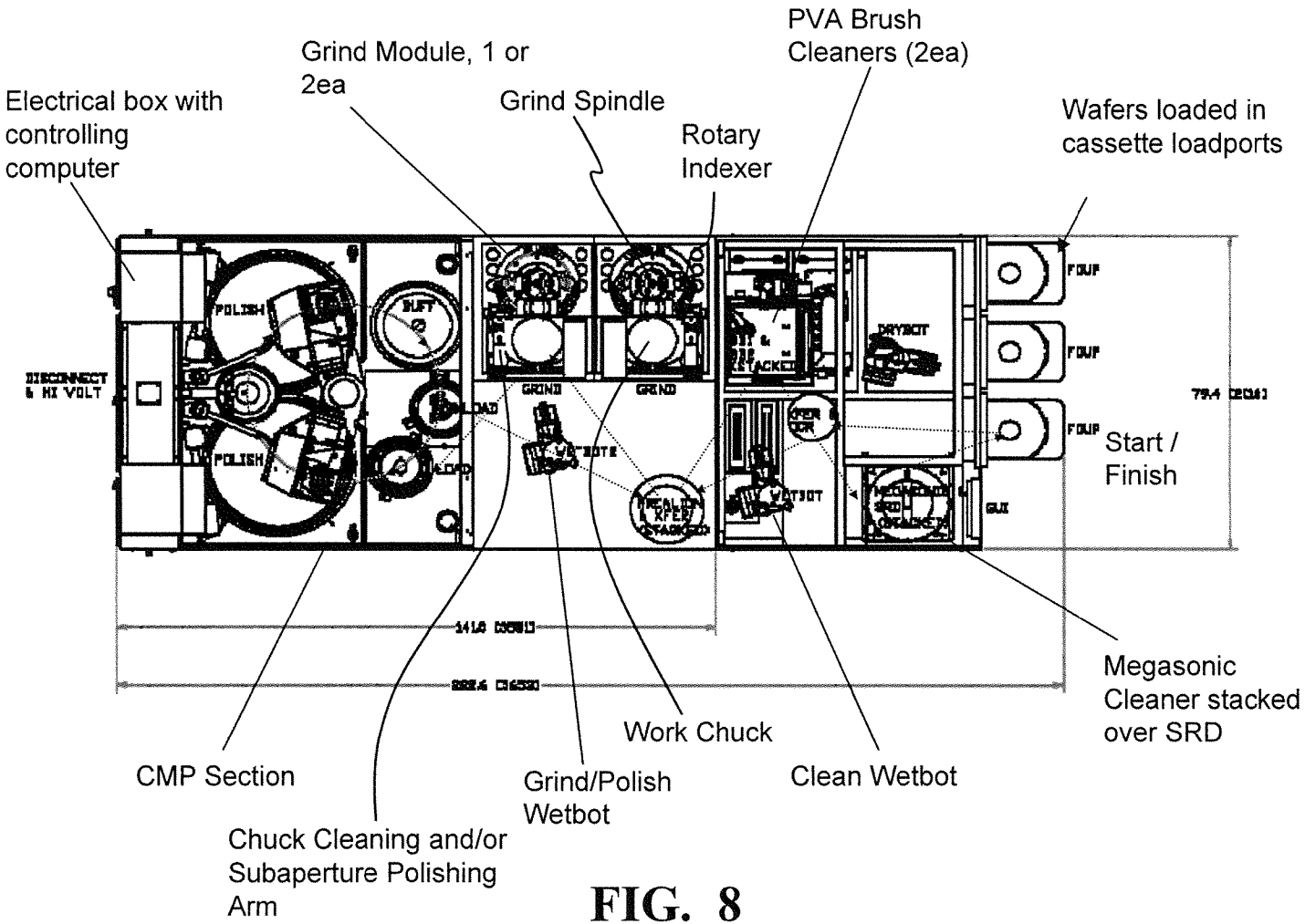
FIG. 8 depicts a simplified overhead view of a tool platform according to some embodiments.

FIG. 8 depicts a simplified overhead view of a tool platform according to some embodiments. The tool platform comprises one or more grind modules (e.g., the grind modules from Strasbaugh described in the co-pending application Ser. No. 61/549,787, filed Oct. 21, 2011, entitled SYSTEMS AND METHODS OF WAFER GRINDING) and one or more Grind/Polish Wetbot handler between a cleaning section and a CMP processing section (e.g., a 3-table CMP processing section).

Some embodiments provide for combined grinding and polishing or planarization, such as chemical mechanical polishing/planarization (CMP). CMP is the term commonly used to refer to polishing processes used in the manufacture of semiconductor devices. It is used to make and retain a planar, smooth surface of the deposited layers on the silicon wafer between various process steps (sometimes more than ten steps) so that optical lithography can retain the necessary short focal length to print the lines, etc. for each successive step, one on top of another. As such, it is common to polish the wafer using a relatively hard upper polishing pad in combination with a soft under pad to achieve local planarity while maintaining global uniformity across the wafer during polishing. For example, Dow Company's IC1000 ("hard") over Suba 4 ("soft") pad stack is widely used by the industry. Chemical polishing slurries that are used in CMP are often developed to emphasize local planarization of devices, while "stopping" when a planar surface is obtained.

On the other hand, "Polishing" is the term commonly used to refer to the polishing process used to take ground prime wafer substrates to a highly smooth (shiny) surface, upon which semiconductor or LED devices can be built. This process commonly uses a relatively soft polishing pad in conjunction with a chemical slurry containing small abrasive particles to flatten and smooth the surface, remove sub surface damage, and/or haze. For example, Dow Company's Suba 600 and Suba 1200 felt-like pads are widely used by the wafering industry for this purpose.

The equipment used for CMP and Polishing is similar, typically including a relatively large polish table (e.g., greater than the diameter of two wafers, and in some instances greater than a diameter of several (3-5) wafers) with affixed polishing pad, slurry delivery system, polishing spindle, and wafer carrier (or "polish head") attached to the spindle. The spindle and attached wafer carrier rotate the wafer against the polishing pad while the pad also rotates against the wafer. Slurry is dispensed on top of the pad and it is carried beneath the wafer by the rotating polish table and pad. CMP machines typically have additional hardware and software to control polish removal and uniformity across the wafer, as well as pad conditioning hardware (to maintain the removal rate on the hard polish pads), and specialized metrology for monitoring results before, during, or after polishing.

Some embodiments further provide for CMP and polishing with stacked silicon wafer applications. In some instances, stacked silicon wafers, which are ground as described above, may be polished or CMP processed subsequent to the grinding. For example, in BSI image sensor manufacturing, the ground surface is made very smooth to allow uniform, efficient transmission of light through the ultra thin silicon (<2 um) backside to the image sensing devices. Although the silicon is ultra-thin, the image sensing devices remain slightly buried below the surface of the silicon after grinding and polishing. Therefore, in this case, a Polishing process is implemented after grinding.

With 3D-IC processes, in some instances, the goal of surfacing is often to expose the TSVs (Through Silicon Vias) in the wafer. These metal (e.g., Copper) TSVs will eventually provide electrical connection points for the stacked wafer. Using grinding alone to expose the TSVs is often undesirable because the high abrasive forces and locally high temperatures involved with grinding can cause stress cracks in the silicon around the TSVs. Therefore, the wafer may be ground to a height that is close to the tops of the TSVs, typically within a threshold distance of the vias, and then polished, etched and/or planarized to expose the TSV's. For example, coarse grinding can be implemented to a first threshold, followed by fine grinding to a second threshold distance from the TSVs, and then the wafer can be polished and/or etched to expose the TSVs. It is often important that the TSVs remain relatively planar with the surface of the silicon to provide a suitable electrical connection point. "Dishing" is a common problem caused by over-polishing of the metal TSVs relative to the silicon. This creates a "dish" shape or contour or depression on top of the metal TSV, as compared with the silicon surface, making it more difficult to make an electrical connection to the TSV. CMP techniques can be used to minimize this dishing.

For stacked wafer applications (e.g., 300 mm stacked wafer applications), the wafers are commonly moved around the factory ("fab") in a cassette housing called a "FOUP," which is an acronym referring to a "Front Opening Unified Pod." These FOUP's provide a clean mini-environment, are designed to work with automated handling equipment, which is a preferred method to move the FOUP's around the Fab (semiconductor fabrication facility), and interface directly with FOUP Loadports on the processing equipment. Wafers are cleaned and dried prior to placing them back into a clean FOUP after processing. Typically, every time a wafer must be cleaned and dried and transported will add to the overall cost and time it takes to make the devices on a wafer. Additionally, every wafer handling step increases risk of damaging a wafer.

Therefore, the combination of wafer grinding and CMP/Polishing into a single, integrated platform is desirable for stacked wafer applications and other processes. By combining these tools into a single tool platform, at least one cleaning and drying step and handling step can be eliminated, and wafer handling is minimized because the wafers need not be cleaned, dried, placed back in the FOUP, and transported between grind and CMP/Polish steps and/or machines.

Accordingly, some embodiments provide system or tool platform that can implement one or more of the grinding methods described above in combination with CMP in this tool platform. In at least some implementations, this tool platform can be placed in a clean room or in the grey area with an interface to clean load/unload zone.

In some embodiments, the tool platform comprises a grind module (e.g., Model 7AH Grinder from Strasbaugh) combined with a polisher (e.g., Model 6EH CMP Dry-in, Dry-Out (DIDO) Polisher (also known as the STB P300 CMP System) from Strasbaugh). The Dry-in, Dry-Out refers to the fact that the Polishing system includes equipment for post-CMP cleaning and drying wafers. The layout of this combination grind/CMP tool platform, in some embodiments, includes splitting or "stretching out" a Model 6EH system (from Strasbaugh) along its longer axis, for example, to about 223 inches, retaining the width (e.g., 80 inches).

Some embodiments combine the features of both a wafer grinder (e.g., a 300 mm wafer grinder) and state-of-the art CMP tools. Further, some embodiments provide full aperture CMP/Polish rather than sub-aperture, which is used in some other systems. The full aperture CMP/Polish can be optioned with all the process controls to achieve ultra precise polish, which in some instances can include zonal control of force on the wafer, end point detection, pad conditioning, and other such controls.

Figure 9:
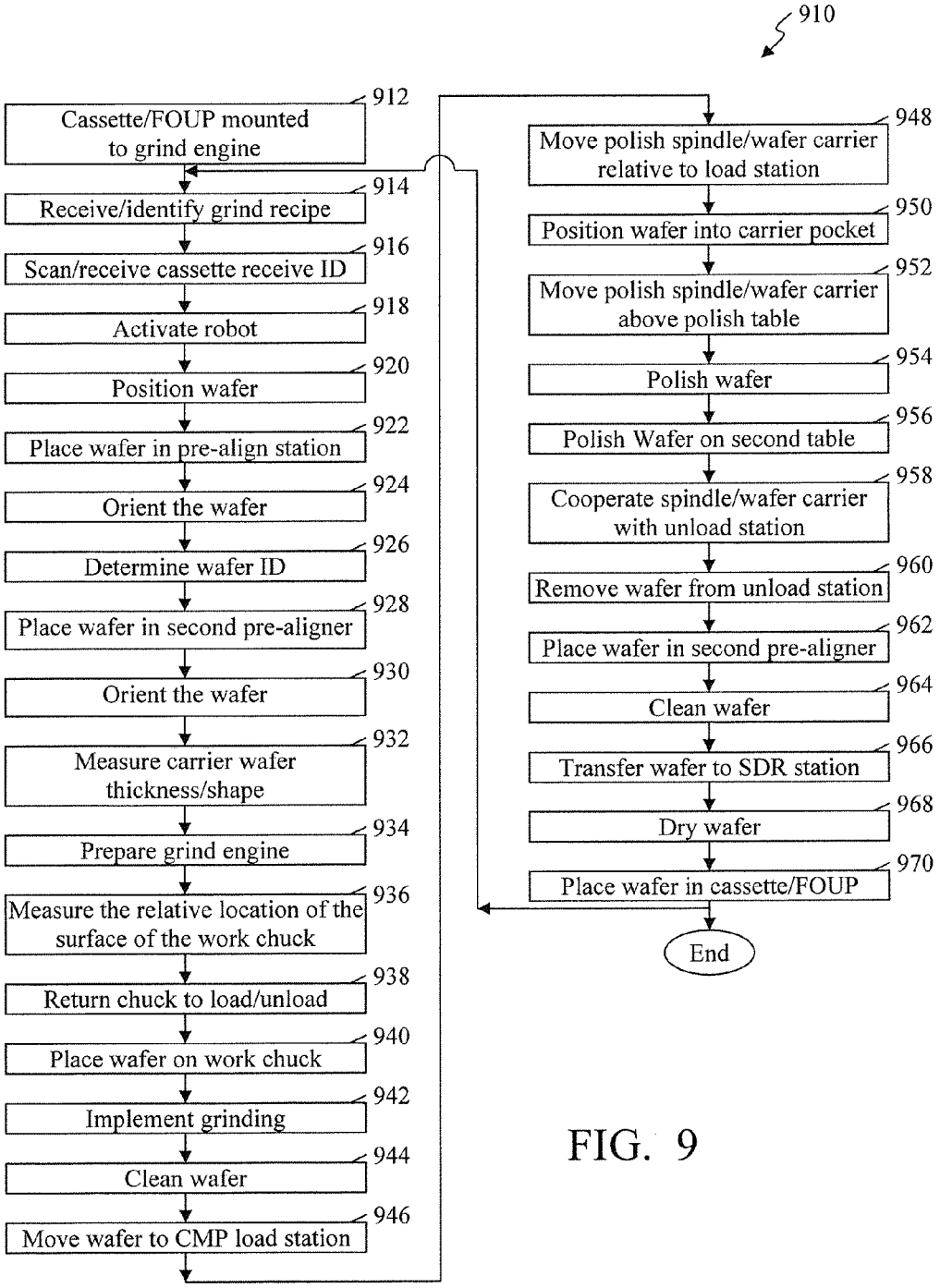
FIG. 9 shows an example of a process in grinding and polishing a substrate, in accordance with some embodiments.

Some embodiments provide processes used to grind and polish or planarize substrates, such as stacked silicon wafers. FIG. 9 shows and below is described an example of a process 910 according to some embodiments in grinding and polishing a substrate.

1. One or more cassettes or FOUPs of wafers is loaded into a cassette input/output (I/O) device mounted to the EFEM of the automated tool (step 912). One or more empty cassettes (or FOUPs) may need to also be loaded as output (or "receive") cassettes for some configurations.

2. An operator or factory host specifies, selects or defines a recipe to be used for grinding, polishing, and cleaning; and a "flow" (or wafer path) through the grinding/polishing tool platform to achieve the recipe may, in at least some instances, also be defined (step 914).

3. The dry robot uses a scanning device to scan the input and output cassettes for wafer presence (step 916). Alternatively, the cassettes can be scanned by the cassette I/O device (for example, FOUP loadports typically have integrated wafer scanning capability).

4. The dry robot uses an end effector to pick up a wafer, such as from the bottom-side from the input cassette and withdraw the wafer from the cassette and into the EFEM (step 918).

5. The wafer is moved to a desired position, which can include rotating 180 degrees resulting in the end effector on top of the wafer (step 920).

6. The wafer is placed by the dry robot onto a first transfer/pre-align station (step 922).

7. In some embodiments, the first transfer/pre-align station may center (or finds the center of) and may orient the wafer to a recipe, flow and/or user-defined angle relative to the end effector pick direction (step 2024). The wafer ID, if present, may also be read by the OCR at the first transfer/pre-align station (step 926).

8. A clean wet robot can then take the wafer from the first transfer/pre-align station and transports it through a clean section of the tool platform, and place the wafer on a second transfer/pre-align station (step 928).

9. The second transfer/pre-align station may, in some embodiments, center (or finds the center of) and may orient the wafer to a recipe, flow and/or user-defined angle relative to the end effector pick direction (step 930).

10. For stacked wafer pair where semi-wafer to be thinned is mounted to a "carrier-wafer," the carrier wafer thickness and/or shape are measured at second transfer/pre-align station (step 932), for example, by an IR wafer thickness sensor, or otherwise obtained (e.g., received from a third party). The measurement data can be stored by the controlling computer for use during the subsequent grinding, processing and/or cleaning processes. In other embodiments, the dry or wet robot may place the wafer into a separate station for measuring. In some implementations, the carrier wafer may be measured in the grind module itself. There can be thickness limitations, however, for some IR sensor types which prevents measuring the carrier wafer thickness from the top and through the device wafer. In those cases the carrier wafer is measured (e.g., shape and/or thickness) outside the grind module at one or both the first or second pre-aligner, or a separate station. Additionally or alternatively, the carrier wafer thickness and/or shape data may be down loaded from the factory or other source to the grind module and/or a controller.

11. During the pre-align process, the grind module is prepared for the wafer (step 934). For example, a top surface of the work chuck can be cleaned with a work chuck cleaning assembly. The rotary indexer indexes the work chuck to the grind position, and the two contact probes reference the top of the work chuck (step 936). The rotary indexer indexes the work chuck to the load/unload position (step 938). The grind chamber lid is opened.

12. A grind/polish wet robot picks the wafer from the second transfer/pre-align station (or metrology station) using an end effector.

13. The grind/polish wet robot places the wafer on top of the work chuck in the grind module. A vacuum force is pulled through the porous surface of the work chuck to seat and hold the wafer. The grind/polish wet robot end effector releases the wafer and retracts from the grind module (step 940).

14A. Grinding is implemented (step 942). The grinding can be implement one of the processes described above, such as the stacked wafer grinding process described (e.g., steps 12 through 28). The grinding can include positioning the work chuck and grind wafer into the grind position, adjusting relative alignment of the grind spindle when needed, and using one or more sensors and/or probes to implement the grinding and achieve desired grinding results.

14B. In some embodiments, the ground surface is rinsed and cleaned (step 944).

15. Following the grinding, the grind/polish wet robot picks the ground wafer from the work chuck, the wafer is flipped 180 degrees and then transported and placed in a pre-CMP cleaner then into a CMP load station (step 946). In some instances, a cleaning process is implemented, which may include a contact cleaning process (e.g., brushes, or the like) to clean the grind swarf particles from the wafer ground surface (and in some instances the chuck) before entering a CMP area.

16. The grind chamber lid closes to allow cleaning of the work chuck by clean water, brushes, stone, blade scraping and/or other relevant cleaning.

17. A polish spindle/wafer carrier moves to a position relative to the load station (step 948).

18. The polish spindle/wafer carrier cooperates with (e.g., lowers onto) the load station, and the wafer is pushed into the wafer carrier pocket by the load station mechanism (step 950). The wafer carrier uses a vacuum to hold the wafer in the carrier pocket.

19. The polish spindle/wafer carrier moves to a position above one of the polish tables (step 952).

20. The spindle lowers and the wafer is polished per the recipe (step 954), where the recipe typically specifies among other things, down force, spindle rotation speed, polish table speed, and slurry flow.

21. The wafer may be polished on two separate polish tables (step 956) and buffed on a third polish table using distinct recipes, polish pads, and slurries for each step. Polishing durations may be controlled via time based user-defined values in the recipe or via removal amount as detected by an endpoint detection system.

22. After polishing is complete, the spindle/wafer carrier moves to a position relative to an unload station.

23. The polish spindle/wafer carrier cooperates with (e.g., lowers onto) the unload station, and the wafer is expelled from the wafer carrier into the unload station (step 958).

24. The grind/polish wet robot uses an end effector to remove the polished wafer from the unload station (step 960).

25. The grind/polish wet robot places the wafer on the second transfer/pre-align station (step 962).

26. A clean wet robot uses an end effector to pick-up the wafer from second transfer/pre-align station.

27. In some instances, the clean wet robot orients the wafer (e.g., flips the wafer 180 degrees) and places the wafer into one of one or more cleaning stations. For example, some embodiments may include three cleaning stations, comprising two PVA brush scrub stations and one optional megasonic cleaning station. The wafer is then cleaned using the user-selected or specified cleaning recipe, including brush speeds, forces, and chemical concentrations and flows (step 964). When the cleaning is complete, the wafer may be transported by the clean wet robot to the other cleaning stations for further cleaning using user-defined recipes.

28. When the cleaning is complete, the clean wet robot uses an end effector to transfer the wafer to the SRD station (step 966).

29. The SRD dries the wafer as defined in the chosen recipe (step 968). Other drying methods may be used and/or may be advantageous, such as marangoni-type drying for some applications.

30. After the spin rinse dry cycle has been completed, the dry robot picks the wafer from the SRD using an end effector.

31. The ground, polished and dried wafer is then placed back in the cassette (step 970).

32. The cycle is repeated for any number of wafers in the cassette. Some embodiments implement the processing in a parallel manner, utilizing multiple grind modules to maximize throughput of the tool. Multiple grind modules and/or polishing stations thus may significantly increase the throughput of the tool.

Accordingly, some embodiments provide grinding and/or polishing applications using the same grind module platform.

With Back-Side Illumination camera chips (BSI) and Thru-Silicon Vias (TSV) for 3D stacked wafers, some embodiments provide methods that allow for consistent grinding to a very thin final thickness and very precise geometries. It also allows grinding and polishing to be done within the same tool platform. Further, some embodiments provide a single tool platform that can grind thin, stacked wafers and/or hard substrates.

One or more controllers, controlling computers and/or processors are included in and/or cooperated with the grind module, grind system and/or tool platform of the present embodiments to provide control of the components and/or processes. Typically the controller receives sensor data and controls the grinding, cleaning, polishing, moving and/or other processing. The controller or controllers can be implemented through one or more processors, controllers, central processing units, computers, logic, software and the like. Further, in some implementations the controller(s) may provide multiprocessor functionality. Computer and/or processor accessible memory can be included in the controller and/or accessed by the controller. In some embodiments, memory stores executable program code or instructions that when executed by a processor of the controller cause the grind module, system and/or tool to control the one or more components. Further, the code can cause the implementation of one or more of the processes and/or perform one or more functions such as described herein.

The methods, techniques, systems, devices, services, servers, sources and the like described herein may be utilized, implemented and/or run on many different types of devices and/or systems. These devices and/or systems may be used for any such implementations, in accordance with some embodiments. One or more components of the system may be used for implementing any system, apparatus or device mentioned above or below, or parts of such systems, apparatuses or devices, such as for example any of the above or below mentioned controllers, as well as user interaction system, sensors, feedback, displays, controls, detectors, motors and the like. However, the use of one or more of these systems or any portion thereof is certainly not required.

The memory, which can be accessed by the processors and/or controllers, typically includes one or more processor readable and/or computer readable media accessed by at least the processors and/or controllers, and can include volatile and/or nonvolatile media, such as RAM, ROM, EEPROM, flash memory and/or other memory technology. Further, the memory can be internal to the system; however, the memory can be internal, external or a combination of internal and external memory. The external memory can be substantially any relevant memory such as, but not limited to, one or more of flash memory secure digital (SD) card, universal serial bus (USB) stick or drive, other memory cards, hard drive and other such memory or combinations of such memory. The memory can store code, software, executables, grind recipes, scripts, data, coordinate information, programs, log or history data, user information and the like.

Some embodiments use one or more features, elements, components, structure, control, or other aspects of the inventions described in U.S. patent application Ser. No. 12/287,550, filed Oct. 1, 2008, entitled A Grinding Apparatus Having an Extendable wheel Mount; and U.S. Pat. No. 7,118,446, entitled Grinding Apparatus and Method, for Walsh et al., issued Oct. 10, 2006; both of which are incorporated herein by references.

The present embodiments provide methods, systems and apparatuses for accurately processing and/or grinding wafers. Many of the methods implement the grinding to desired thicknesses and/or shapes through a single grind system. Further, the present embodiments provide grinding of stacked and non-stacked wafers.

Figure 10:
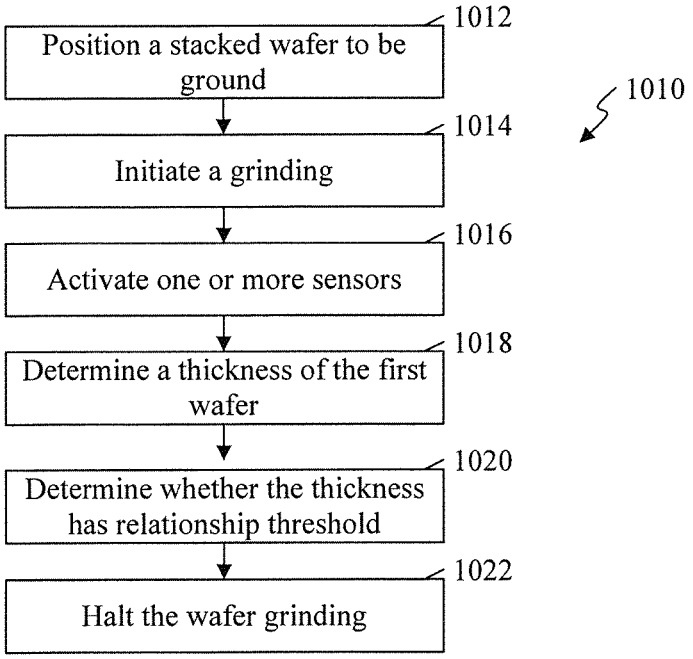
FIG. 10 shows a simplified flow diagram of a process of grinding a wafer, in accordance with some embodiments.

FIG. 10 shows a simplified flow diagram of a process 1010 of grinding a wafer in accordance with some embodiments. In step 1012, a stacked wafer is positioned into a position to be ground. The stacked wafer, in some embodiments, comprises a first wafer secured with a carrier-wafer, where the first wafer is secured with the carrier-wafer such that a surface of the first wafer is exposed to be ground. In step 1014, a grinding of the first wafer is initiated while supported by the carrier-wafer. In step 1016, one or more sensors are activated relative to the first wafer while grinding the first wafer.

In step 1018, a thickness of the first wafer is determined separate from a thickness of the carrier-wafer as a function of data from the one or more sensors and while grinding the first wafer. In step 1020, it is determined whether the thickness of the first wafer has a predefined relationship with a first thickness threshold. In step 1022, the wafer grinding is halted when the thickness of the first wafer has the predefined relationship with the first thickness threshold.

Figure 11:
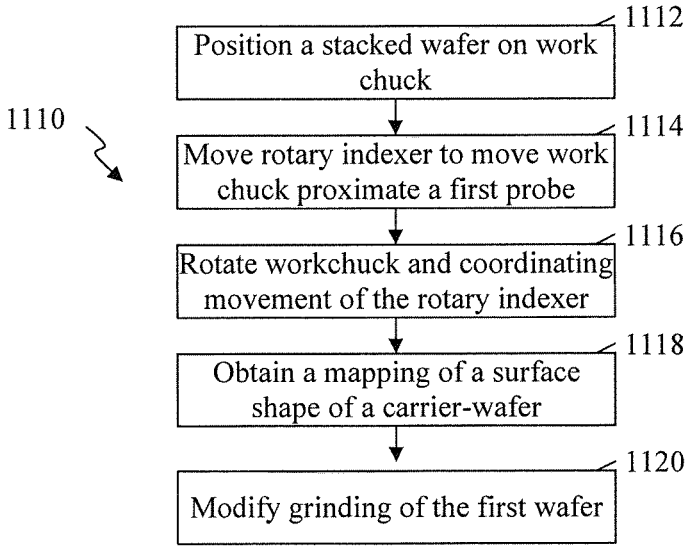
FIG. 11 shows a simplified flow diagram of a method of grinding a wafer, in accordance with some embodiments.

FIG. 11 shows a simplified flow diagram of a method 1110 of grinding a wafer in accordance with some embodiments. In step 1112, a stacked wafer is positioned onto a work chuck. The work chuck is secured with a rotary indexer and the stacked wafer comprises a first wafer to be ground. In step 1114, the rotary indexer is moves to move the work chuck to position the stacked wafer proximate a first probe. In step 1116, the work chuck is rotated to rotate the stacked wafer while coordinating movement of the rotary indexer moving the work chuck and stacked wafer relative to the first probe while the first probe is activated. In step 1118, a mapping of a surface shape of a surface of a carrier-wafer is obtained. In step 1120, a grinding of the first wafer to be ground is modified in accordance with the mapping of the surface of the carrier-wafer, wherein the carrier-wafer is configured to support the first wafer while the first wafer is being ground.

While the invention herein disclosed has been described by means of specific embodiments, examples and applications thereof, numerous modifications and variations could be made thereto by those skilled in the art without departing from the scope of the invention set forth in the claims.

What is claimed is:

1. A method of processing wafers, the method comprising:

positioning a stacked wafer into a position to be ground, wherein the stacked wafer comprises a first wafer secured with a carrier-wafer, wherein the first wafer is secured with the carrier-wafer such that a surface of the first wafer is exposed to be ground;

initiating a grinding of the first wafer while supported by the carrier-wafer;

activating one or more sensors relative to the first wafer while grinding the first wafer;

determining, while grinding the first wafer, a thickness of the first wafer separate from a thickness of the carrier-wafer as a function of data from the one or more sensors;

determining whether the determined thickness of the first wafer has a predefined relationship with a first thickness threshold; and halting the wafer grinding when the thickness of the first wafer has the predefined relationship with the first thickness threshold.

2. The method of claim 1, further comprising:

obtaining a mapping of a surface of the carrier-wafer upon which the first wafer is secured; and modifying the grinding in accordance with the mapping of the surface of the carrier-wafer.

3. The method of claim 2, further comprising:

positioning the first wafer onto a work chuck, wherein the work chuck is supported by a rotary indexer;

rotating the rotary indexer moving the work chuck through a partial rotation of the rotary indexer to position the first wafer proximate a first sensor;

rotating the work chuck to rotate the first wafer while coordinating movement of the rotary indexer moving the work chuck and carrier wafer relative to the first sensor while the first sensor is active; and recording a surface shape of the surface of the first wafer as measured by the first sensor during the coordinated movement of the rotary indexer and the rotation of the work chuck.

4. The method of claim 3, wherein the recording the surface shape of the surface of the first wafer comprises mapping thickness and uniformity variations.

5. The method of claim 2, further comprising:

obtaining a mapping of a surface of a work chuck upon which the carrier-wafer and first wafer will be positioned during grinding; and modifying the grinding in accordance with the mapping of the surface of the carrier-wafer and the mapping of the surface of the work chuck.

6. The method of claim 1, wherein the activating the one or more sensors while grinding the first wafer comprises activating a first sensor to measure the surface of the first wafer, and activating a second sensor to measure a surface of a work chuck; and wherein the determining the thickness of the first wafer separate from the carrier-wafer comprises determining a thickness of the first wafer as a function of the measurements obtained from the first sensor and the second sensor and a thickness of the carrier-wafer.

7. The method of claim 6, wherein the halting the wafer grinding when the thickness of the first wafer has the predefined relationship with the first thickness threshold comprises halting the wafer grinding such that the surface of the first wafer does not expose one or more vias formed in the first wafer; and polishing or etching the surface of the first wafer to expose the one or more vias.

8. The method of claim 6, wherein the initiating the grinding of the first wafer comprises applying a coarse grind wheel to the surface of the first wafer;

initiating a subsequent grinding of the surface of the first wafer by applying a fine grind wheel to the surface of the first wafer;

activating the one or more sensors while grinding the first wafer with the fine grind wheel to measure the thickness of the first wafer;

determining, while grinding the first wafer with the fine grind wheel, the thickness of the first wafer separate from the thickness of the carrier-wafer;

determining whether the determined thickness of the first wafer has a predefined relationship with a second thickness threshold; and halting the wafer grinding when the thickness of the first wafer has the predefined relationship with the second thickness threshold.

9. The method of claim 1, further comprising:

positioning the first wafer and the carrier-wafer onto a work chuck of a grind engine, wherein the work chuck is secured with a rotary indexer configured to rotate the work chuck to one or more positions within the grind engine;

rotating the rotary indexer to position the work chuck and first wafer in an edge grind position; and performing an edge grind on an edge of the first wafer.

10. The method of claim 9, wherein the performing the edge grind comprises performing the edge grind through cooperative movement of the rotary indexer and a vertical feed adjustment to adjust a feed of a grind wheel into contact with the first wafer edge.

11. The method of claim 1, further comprising:

polishing the first wafer following the completion of the wafer grinding.

12. A method of grinding a wafer, the method comprising:

positioning a stacked wafer onto a work chuck, wherein the work chuck is secured with a rotary indexer and the stacked wafer comprises a first wafer to be ground;

moving the rotary indexer to move the work chuck to position the stacked wafer proximate a first probe;

rotating the work chuck to rotate the stacked wafer while coordinating movement of the rotary indexer moving the work chuck and stacked wafer relative to the first probe while the first probe is activated;

obtaining a mapping of a surface shape of a surface of a carrier-wafer; and modifying a grinding of the first wafer to be ground in accordance with the mapping of the surface of the carrier-wafer, wherein the carrier-wafer is configured to support the first wafer while the first wafer is being ground.

13. The method of claim 12, further comprising:

grinding a surface of the first wafer in accordance with the modified grinding while the first wafer is supported by the carrier-wafer;

activating the first probe while grinding the first wafer to measure at least the surface of the first wafer;

determining, while grinding the first wafer and as a function of measurements from the first probe, a thickness of the first wafer distinct from a thickness of the carrier-wafer; and halting the grinding of the first wafer when the thickness of the first wafer has a predefined relationship with a first thickness threshold.

14. The method of claim 13, further comprising:

activating a second contact probe to measure a surface of the work chuck; and wherein the determining the thickness of the first wafer comprises determining, while grinding the first wafer, a thickness of the first wafer as a function of the measurements obtained from the first probe and the second probe and a thickness of the carrier-wafer.

15. The method of claim 13, wherein the halting the grinding of the first wafer comprises halting the grinding of the first wafer such that the surface of the first wafer are within a threshold distance from one or more vias formed in the first wafer and such that the one or more vias are not exposed at the surface of the first wafer.

16. The method of claim 13, further comprising:

mapping a surface of the work chuck upon which the carrier-wafer and first wafer are positioned during grinding; and wherein the modifying the grinding comprises modifying the grinding in accordance with the mapping of the surface of the carrier-wafer and the mapping of the surface of the work chuck.

17. The method of claim 12, further comprising:

adjusting a relative alignment of a grind spindle of the grind engine relative to the surface of the first wafer in accordance with the mapping of a thickness of the carrier-wafer and the mapping of the surface of the work chuck to achieve desired post-grind wafer surface shape of a surface of the first wafer.

18. The method of claim 12, further comprising:

positioning the first wafer and the carrier-wafer onto the work chuck of the grind engine, wherein the rotary indexer configured to move the work chuck to one or more positions within the grind engine;

activating the rotary indexer to move the work chuck and first wafer to an edge grind position; and performing an edge grind on an edge of the first wafer through further and cooperative movement of the rotary indexer and a vertical feed adjustment to adjust a feed of a grind wheel into contact with the first wafer edge.

* * * * *